US007757905B2

(12) United States Patent
Strand et al.

(10) Patent No.: US 7,757,905 B2
(45) Date of Patent: Jul. 20, 2010

(54) SPRAY ACTUATOR

(75) Inventors: Toralf H. Strand, Exeter, NH (US); Thomas G. Lacey, Chester, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 490 days.

(21) Appl. No.: 11/483,934

(22) Filed: Jul. 10, 2006

(65) Prior Publication Data

US 2007/0039979 A1 Feb. 22, 2007

(51) Int. Cl.
*B65D 83/00* (2006.01)

(52) U.S. Cl. ..... 222/402.11; 222/402.13; 222/404; 222/153.11; 222/153.13

(58) Field of Classification Search ..... 222/402.11, 222/402.13, 153.13, 153.01, 153.02, 153.11, 222/153.12, 153.14, 404
See application file for complete search history.

(56) References Cited

U.S. PATENT DOCUMENTS

| | | | | |
|---|---|---|---|---|
| 3,185,350 | A | 5/1965 | Abplanalp et al. | |
| 3,474,939 | A | 10/1969 | O'Donnell et al. | |
| 3,608,791 | A | 9/1971 | Jordan et al. | |
| 3,721,423 | A | 3/1973 | Shay | |
| 3,729,119 | A * | 4/1973 | Sette et al. | 222/153.11 |
| 3,744,682 | A | 7/1973 | Blank | |
| 3,754,689 | A | 8/1973 | Blank | |
| 3,782,605 | A * | 1/1974 | Messenger | 222/153.11 |
| 3,828,982 | A * | 8/1974 | Steigerwald | 222/153.11 |
| 3,848,778 | A | 11/1974 | Meshberg | |
| 3,884,393 | A | 5/1975 | Wassilieff | |
| 3,937,368 | A | 2/1976 | Hoagland | |
| 4,065,036 | A | 12/1977 | Kirk, Jr. | |
| 4,071,173 | A | 1/1978 | Horan | |
| 4,324,351 | A * | 4/1982 | Meshberg | 222/402.11 |
| 4,418,842 | A | 12/1983 | Di Loreto | |
| 4,572,410 | A | 2/1986 | Brunet | |
| 4,773,567 | A | 9/1988 | Stoody | |
| 5,027,982 | A | 7/1991 | Demarest | |
| 5,158,206 | A | 10/1992 | Kobayashi et al. | |
| 5,242,087 | A | 9/1993 | Keldenich et al. | |
| 5,379,924 | A | 1/1995 | Taylor | |
| 5,388,730 | A | 2/1995 | Abbott et al. | |
| 5,624,055 | A | 4/1997 | Clanet et al. | |
| 5,649,645 | A | 7/1997 | Demarest et al. | |
| 6,062,432 | A | 5/2000 | Estrada | |
| 6,126,044 | A | 10/2000 | Smith | |
| 6,196,423 | B1 | 3/2001 | Erxleben | |
| 6,302,302 | B1 | 10/2001 | Albisetti | |
| 6,398,082 | B2 | 6/2002 | Clark et al. | |

(Continued)

FOREIGN PATENT DOCUMENTS

| | | |
|---|---|---|
| EP | 0 119 084 | 9/1984 |

*Primary Examiner*—J. Casimer Jacyna
(74) *Attorney, Agent, or Firm*—Daniels Patent Law PLLC; Scott A. Daniels

(57) ABSTRACT

An aerosol spray actuator for a pressurized aerosol canister and in particular trigger or button actuated spray actuators having three main parts to simplify the mechanical moving parts of a spray actuator. An actuator button, an actuator base and finally a nozzle piece being inserted at the very end of a product dispensing passage embodied either in the body or the trigger part. A mechanism for permitting and blocking the actuation of the spray actuator is also provided so that inadvertent operation of the actuator can be prevented.

12 Claims, 28 Drawing Sheets

U.S. PATENT DOCUMENTS

| | | | | |
|---|---|---|---|---|
| 6,523,722 | B1 | 2/2003 | Clark et al. | |
| 6,601,735 | B2 | 8/2003 | Milian et al. | |
| 6,691,896 | B2 | 2/2004 | Meshberg | |
| 6,695,171 | B2 | 2/2004 | Walters et al. | |
| 6,758,373 | B2 | 7/2004 | Jackson et al. | |
| D497,808 | S | 11/2004 | Morris et al. | |
| 6,817,488 | B2 | 11/2004 | Meshberg | |
| 6,832,700 | B2 | 12/2004 | Roberts et al. | |
| 7,044,341 | B2 * | 5/2006 | Sanchez | 222/404 |
| 2003/0168473 | A1 | 9/2003 | Ho | |
| 2004/0026454 | A1 | 2/2004 | Meshberg | |
| 2004/0140324 | A1 | 7/2004 | Meshberg | |
| 2005/0017027 | A1 | 1/2005 | Yerby et al. | |

* cited by examiner

SPRAY ACTUATOR

FIELD OF THE INVENTION

This invention relates to an aerosol spray actuator for dispensing an aerosolized product from a container, and more specifically, to certain new and useful improvements in the configuration, function, manufacturing and structure of an aerosol spray actuator having an actuating position for dispensing aerosol from a container and an unactuated position where the spray actuator is prevented from actuating a valve in the container.

BACKGROUND OF THE INVENTION

Aerosol containers containing a wide variety of active components or contents under pressure such as insect repellents, insecticides, hairsprays, creams or foams and so on have been marketed widely for household, commercial and industrial purposes.

In conventional aerosol containers, the outlet is normally a tubular valve stem element springably biased into a closed position which, when depressed into the body of the container opens the valve and releases the contents which are held under pressure. When the applied force at the valve stem is removed, the valve stem returns to its closed position simultaneously stopping the outward flow of the pressurized contents of the container. In one type of aerosol containers, a spray actuator, or button, is fitted directly over the valve stem such that when the actuator is depressed the valve stem is simultaneously depressed or tilted against a spring bias causing the contents of the container to be released via an outlet in the actuator. Release of the pressure at the actuator returns the valve stem to its equilibrium position. Generally, to operate the actuator an enclosing protective cover has to be removed to expose the actuator. Such covers which are then placed back over the button and valve stem, can often be misplaced or discarded by the end-users.

In another type of aerosol containers, the cap is designed with the actuator as part of its structure whereby the release of the pressurized contents is done by depressing a trigger which is in turn part of the actuator structure. The contents of the aerosol container is ejected from the actuator and exits through a space or orifice in the cap. This is commonly termed a spray-through cap. In this type of aerosol container the trigger is not protected from accidental pressing of the cap by the user. Although in this type of cap, the user is more protected from overspray by the cap, the inconvenience of such devices lies in the accidental actuation of the trigger and inadvertent spraying of the contents is present.

U.S. Pat. No. 6,523,722 to Clark et al. discloses a spray head for aerosol or pump spray containers. Clark '722 includes an intricate base portion having a fluid outlet passageway integral with the base and mounted on the base via a living hinge. The top or button of Clark '722 includes a flexible member which is also integral with and mounted via a living hinge with a lower portion of the top. The flexible member flexes relative to the top when depressed by a user's finger, and when appropriately rotationally aligned with the base portion causes movement of the passageway on the base to actuate a valve in the aerosol container. The draw back to Clark is in the assembly of the actuator, in particular after molding the separate pieces the top can only be engaged with the base in one direction and that the engagement of the parts must be performed carefully so as to correctly align the mating parts of the separate base and top. Thus, the challenging assembly of this product can cause manufacturing problems and also raises the cost of each actuator.

U.S. patent application Ser. No. 10/792,074 to Yerby et al. is similar to Clark '722 in that the base portion of the actuator includes the fluid outlet passage formed integrally therewith and is also an intricate part to mold especially in light of the numerous windows and passages formed through the different sidewalls of the base portion. These windows lead to a relatively complicated mold with numerous shut-offs, or endpoints which must match up when the molds are closed. Any misalignment of the molds leads to flashing, i.e. extra material at the mold junction which can effect the operation of the actuator and lead to substantial increase in manufacturing costs if it must be removed from the part after molding. Also, the top can only be engaged with the base portion in one direction and must be specifically aligned so as to properly align the top portion with the base portion.

It is therefore desirable to provide an aerosol spray actuator and a method of making the actuator which is capable of overcoming these previously known deficiencies.

SUMMARY OF THE INVENTION

The present invention provides an aerosol spray actuator for a pressurized aerosol canister that overcomes certain shortcomings of prior art actuators and in particular locking actuated spray actuators. Because of their functionality, locking spray actuators are usually composed of numerous parts which are firstly very difficult to mold, and secondly and perhaps more importantly, difficult to assemble. The present invention simplifies the mechanical moving parts of a spray actuator to an actuator button, an actuator base and finally a nozzle piece being inserted at the very end of a product dispensing passage embodied either in the body or the trigger part. Thus, there are only three parts to the present invention which are constructed in various combinations to embody the present invention.

It is therefore an object of the present invention to provide an aerosol spray actuator which can obviate the above described problems inherent in the conventional spray actuators.

It is another object of the present invention to provide an aerosol spray actuator wherein the actuator can be positioned in an operative or inoperative position analogous to an on and off position where in the inoperative position the actuator is prevented from actuating a valve of the container.

It is another object of the present invention to provide an aerosol spray actuator wherein the operative or inoperative position is easily attained by simple basic movements by the user.

It is still another object of the present invention to provide an aerosol spray actuator wherein the operative and inoperative position of the cap is visually, tactile or audibly easily identified by any user.

It is still another object of the present invention to provide an aerosol spray actuator wherein an audible position indicator is provided to indicate when the actuator is either in the operative or inoperative position

BRIEF DESCRIPTION OF THE DRAWINGS

The invention will now be described, by way of example, with reference to the accompanying drawings in which.

DETAILED DESCRIPTION OF THE PREFERRED EMBODIMENTS

Figure 1A:
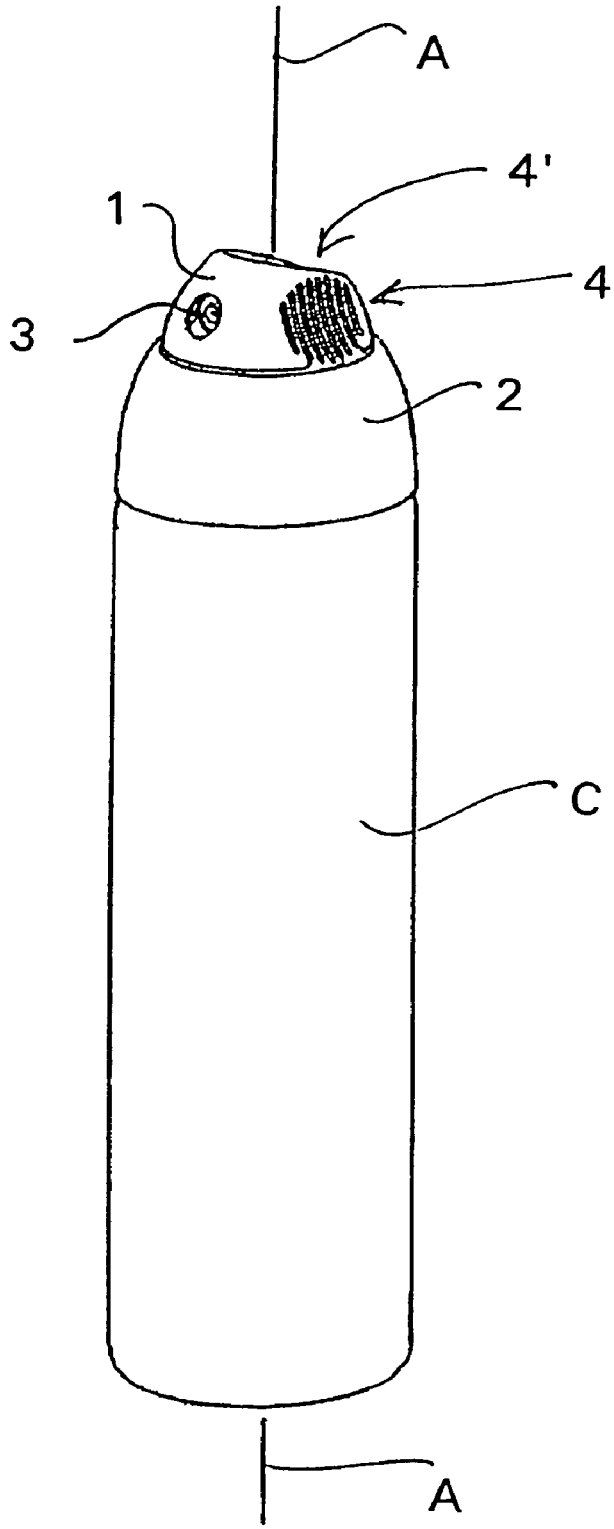
FIG. 1A is a perspective view of a twist top actuator and an aerosol spray can in accordance with an embodiment of the present invention.
Figure 1B:
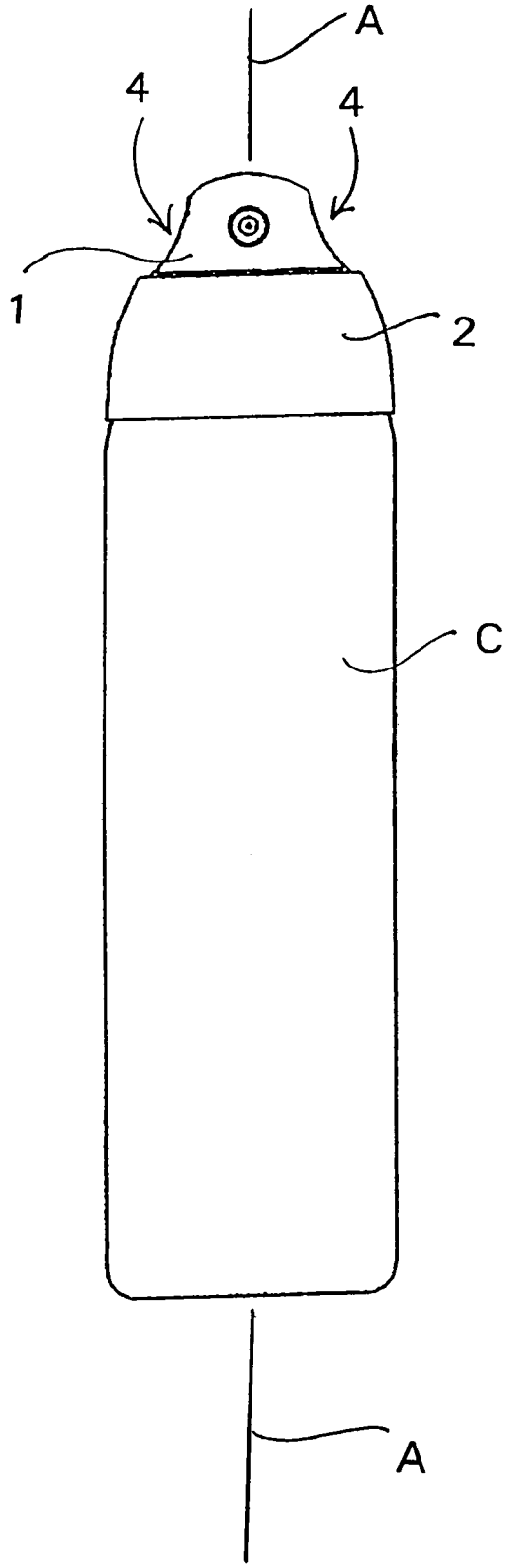
FIG. 1B is a front planar view of the twist top actuator and an aerosol spray can in accordance with the first embodiment of the present invention.

A twist top actuator, shown in FIGS. 1A-B, may be provided with three (3) main parts generally supported on an aerosol spray can C, an actuating button 1, a base or skirt 2 and a nozzle 3. The actuating button 1 in the present embodiment is radially rotatable about a longitudinal axis A relative to the base 2 so that there is defined an actuating position and a non-actuating position of the button 1 relative to the base 2. By "radially rotatable" it is to be understood that the button 1 has a circumference defined by a radius extending from and rotatable about the longitudinal axis A. The button 1 is provided on either side with indented or concave finger gripable sections 4 which allow a user to radially rotate the button 1 relative to the base 2. Another slightly indented, angled or concave section may be provided in a top most portion of the button 1 to provide a user with an appropriate and ergonomic finger pad 4' to depress the button relative to the base 2.

Figure 2A:
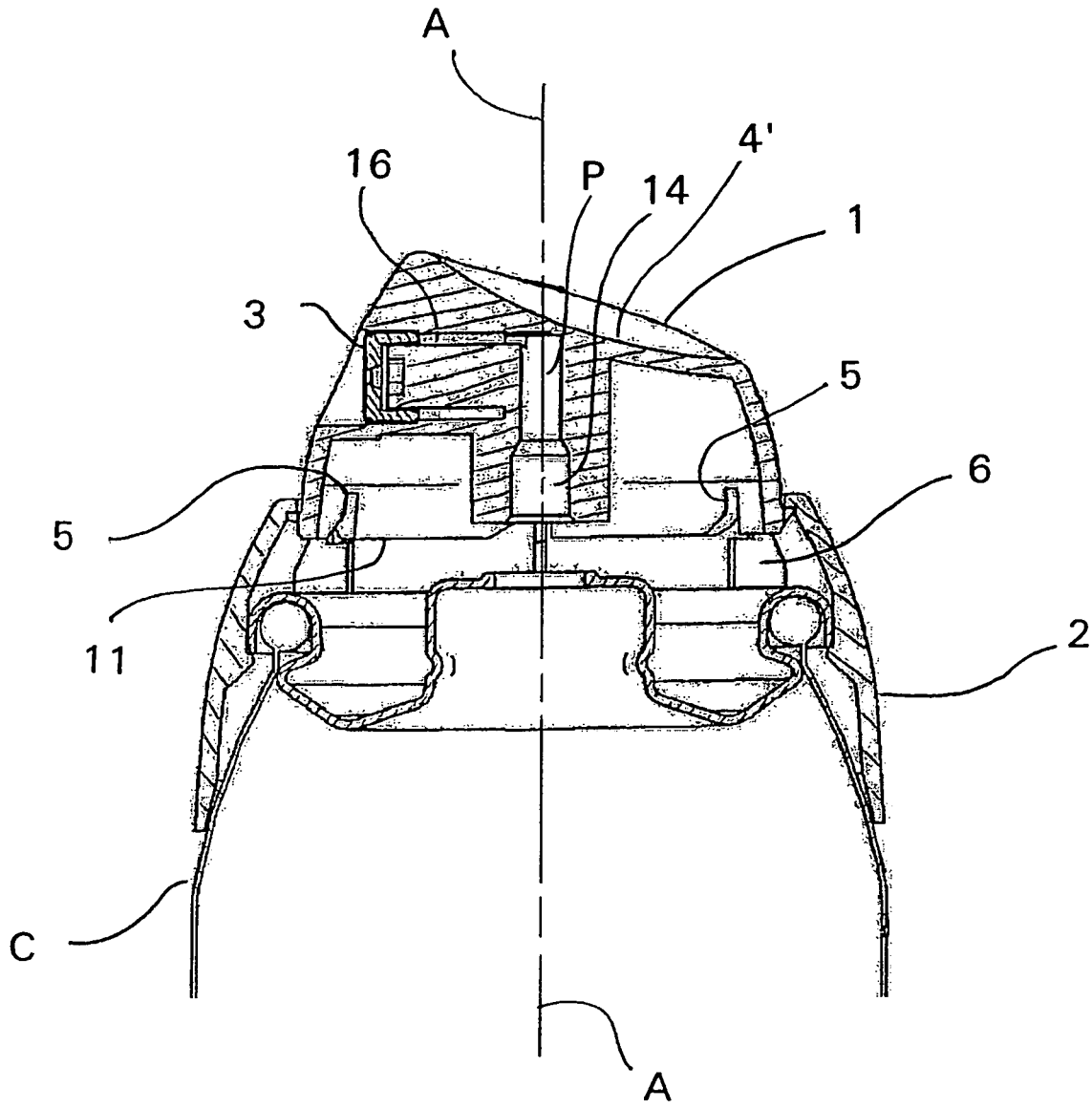
FIGS. 2A-C are cross-sectional views of the twist top actuator in accordance with relative actuating and non-actuation positions.

When the button 1 and the base 2 are radially aligned in the actuating position as shown in FIG. 2A, the button 1 is free to be moved vertically, or axially by pressure on the finger pad 4' along the longitudinal axis A defined through the center of the can and valve stem. The movement of the button 1, is axial relative to the base so as to press down a valve stem (not shown) of the valve in the spray can or container C to which the actuator is attached.

The button 1 defines an integral product passage P which comprises an inlet passage 14 for communicating directly with the valve stem connecting to an outlet passage 16 where the nozzle 3 is attached and from which the pressurized aerosol is released directly into the environment. The top surface of the button defines the finger pad 4' or finger engaging surface where a user places their finger to apply pressure to actuate the button, and a bottom edge 11 of the button 1 is provided with at least a slot 5 or notch formed substantially perpendicular relative to the horizontal bottom edge 11. The slot 5 is provided with a slanting ramp portion 19 which is formed at an angle between the bottom edge and a first sidewall of the slot 5. A second substantially vertical sidewall is provided opposite the first sidewall to define the slot 5.

Figure 2B:
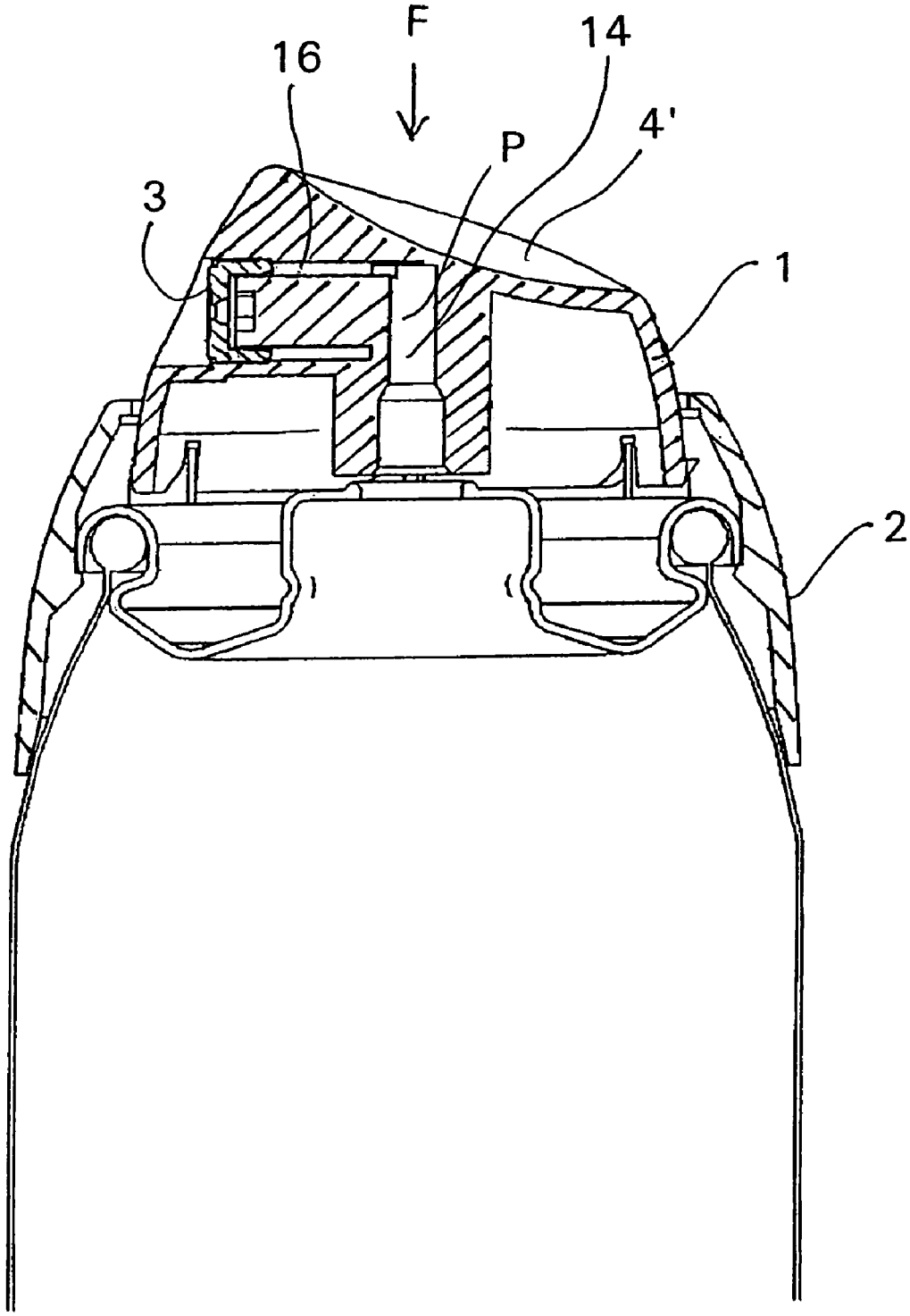

The ramp portion assists in guiding the slot 5 over the relative support ribs 6 when the button is turned to the actuating position shown in FIG. 2A, and pushed down by a force F by the user as seen in FIG. 2B to the actuated position. It is to be appreciated that similar slots 5 may be provided around the circumference of the bottom edge 11 of the button 1 for facilitating the vertically biased movement of the button 1 relative to the base 2.

In the actuating position shown in FIG. 2A, the slots 5 in the lower edge of the button 1 are located above the support ribs 6 on the base 2 and the button 1 is free to press down on the valve stem (not shown) of the can to release the contents thereof. In this position, the slots 5 are aligned vertically over the ribs 6 so that when the button 1 is pushed down, the ribs 6 are received in the slots 5 as seen in FIG. 2B and there is enough vertical travel of the button 1 to depress the valve stem to the extent necessary to actuate the valve and release the pressurized product from the spray can C. Any slight misalignment of the ribs 6 and the slots 5 is accommodated by the angled ramp of each of the slots 5 so that the button 1, even if not aligned exactly over the ribs 6 will self-align by the ribs sliding along the angled ramp of the slot 5 and hence into the slot 5 as the button 1 is pushed down into the base 2.

Figure 2C:
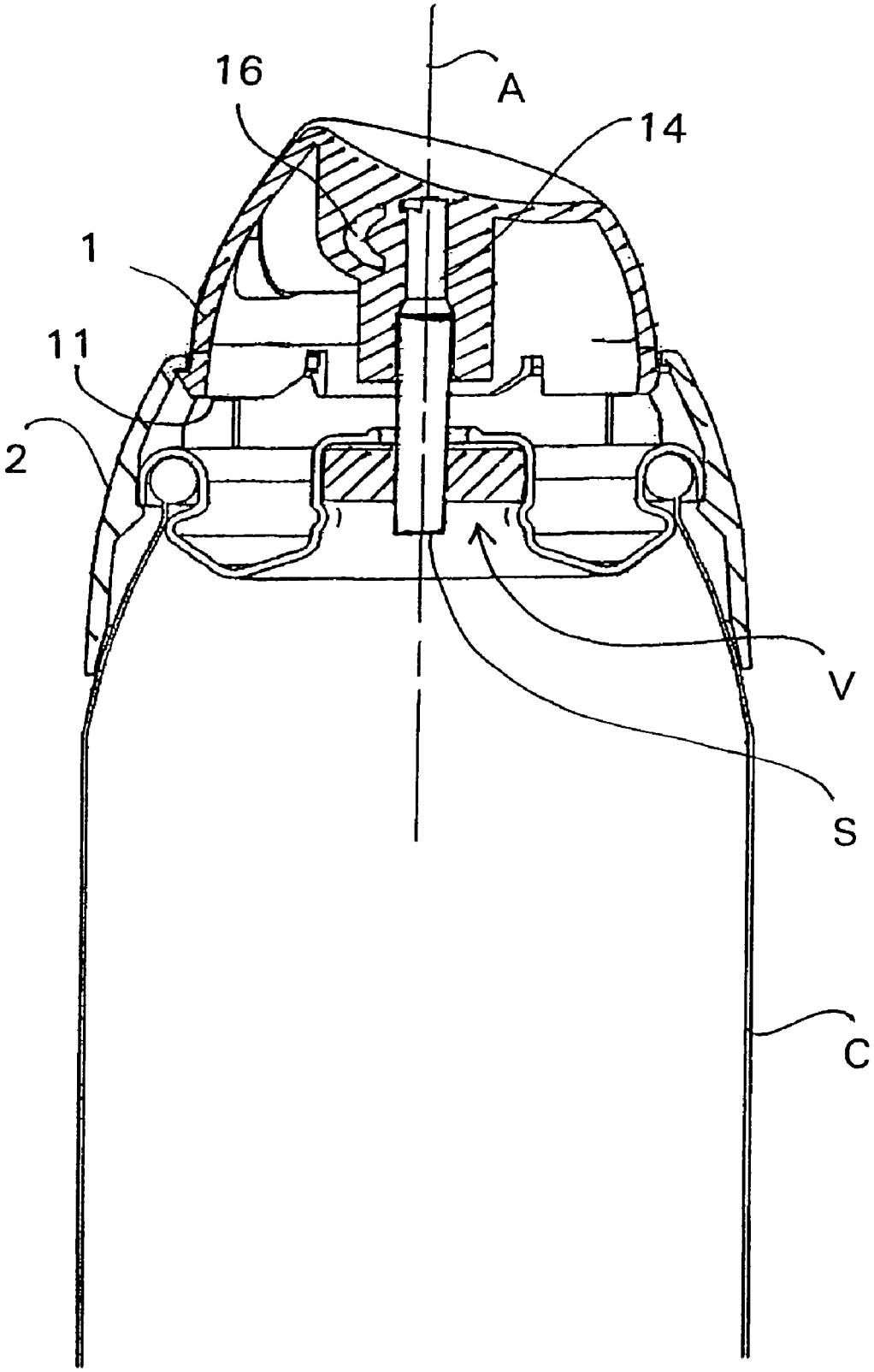

To attain the non-actuating position as shown in FIG. 2C where the button 1 cannot be depressed to actuate the valve V by pushing down on the valve stem S, the button 1 is rotated, or turned in a radial manner, i.e. around the vertical axis A relative to the base 2, to the non-actuating position where the lowermost or bottom edge 11 of the button 1 rides up onto and over the top edge of the support ribs 6. The ramp portion 19 assists in this regard and as the button 1 is rotated, the slanting ramp portion 19 vertically, i.e. axially, raises the bottom edge 11 up onto the top edge of the support ribs 6. Consequently, the inlet passage 14 is axially moved relative to the valve stem S in an upward, vertical or axial relation so that space is formed between an inner ledge formed in the product passage P to directly press on the valve stem S, and the end of the valve stem S. This space provides for further protection against inadvertent actuation because in the non-actuating position the inner ledge of the product passage is spaced from the end of the valve stem. In other words, the slots 5 are rotated out of radial alignment with the ribs 6 and the product passage is moved axially out of engagement with the valve stem which prevents downward force on the button 1 from depressing the button 1 and actuating the valve stem S of the spray can C.

Although the support ribs 6 in the base 2 can stop the button from being depressed, there is no structure in the device which entirely prevents the relative radial rotation between the button 1 and the base 2, i.e. the button does not "lock" into any specific operative or inoperative position relative to the base. A position indicating means may be provided such as a tactile, visual or audible signal which makes the user aware of either the actuating or non-actuating position. This indicating means may provide some partial or limited resistance to relative rotation between the button 1 and base 2 via slightly overlapping radially or vertically oriented tabs, or other such type of minimally frictionally engaging elements, but does not lock the button into any specific position. By "lock" we understand for example a child safety lock, wherein the button 1 cannot be rotated by normal turning force relative to the base 2 without physical removal of a locking mechanism as described in many known devices.

Figure 3A:
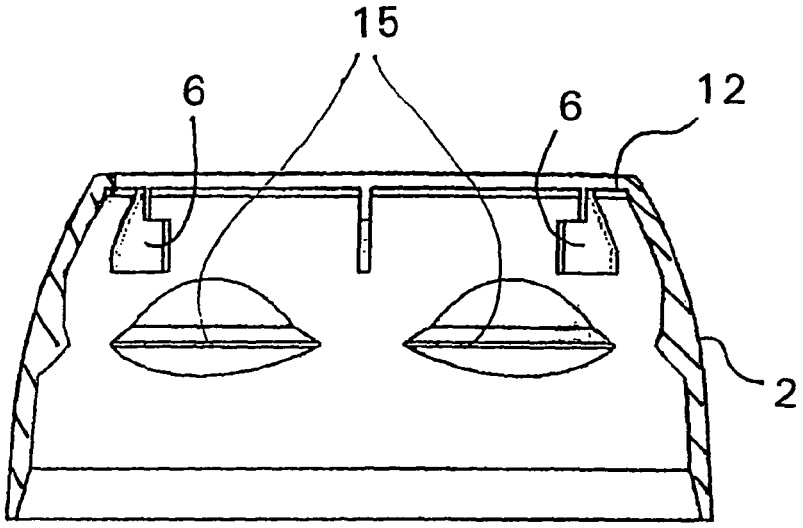
FIGS. 3A-B are respectively a cross sectional and a perspective view of the base or collar of the twist top actuator.
Figure 3B:
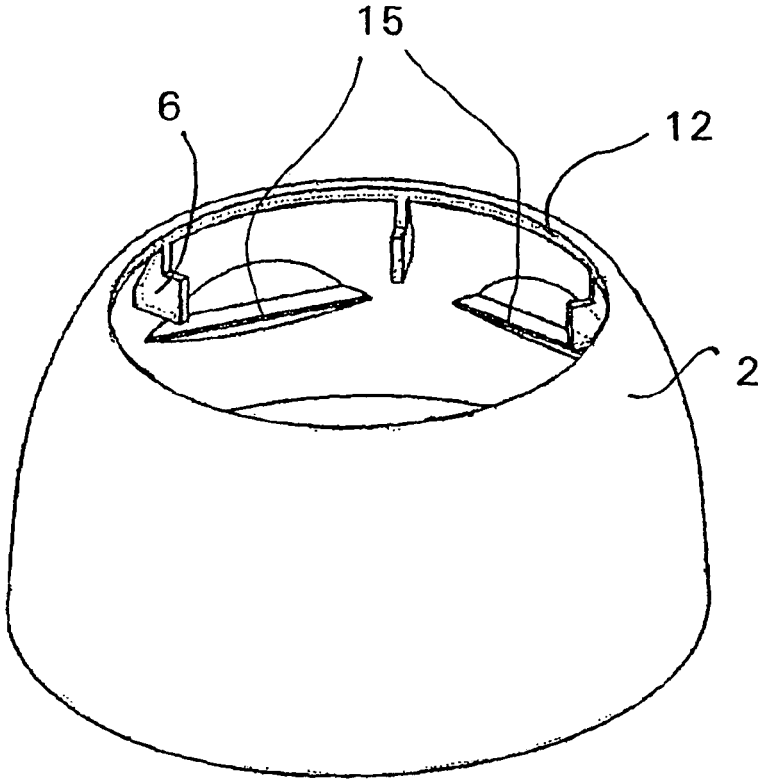

FIGS. 3A and 3B show the base 2 or skirt of the twist top actuator in further detail, including the spray can collar engaging edges 15 which protrude circumferentially inwardly at least partially around an interior wall of the base 2. Each of these collar engaging edges 15 engages in a "snap-fit" over the collar of the spray can (as better seen in FIGS. 2A and 2B) to biasly engage underneath the collar or rim and thus secure the twist top actuator to the aerosol spray can. The ribs 6 are shown extending radially inwards from the inner wall of the base 2 and may be spaced any desired distance apart in order to facilitate the complete engagement and smooth operability of the button movement relative to the base 2.

Figure 4A:
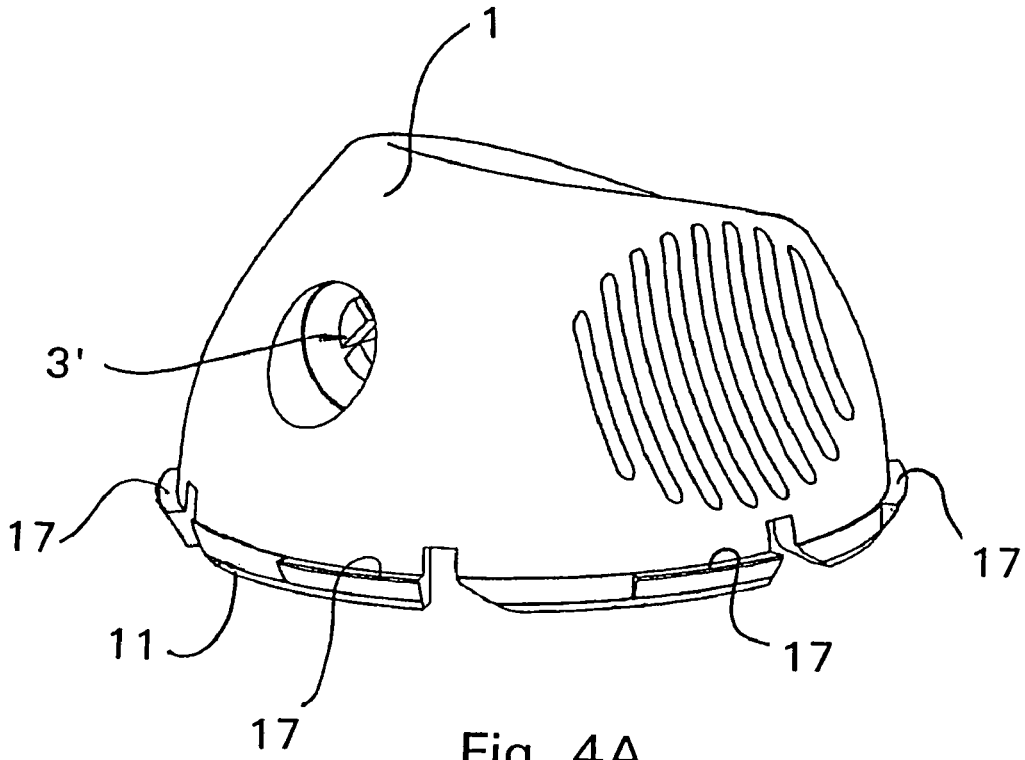
FIGS. 4A-B are respectively a perspective and a front view of the twist top actuator.
Figure 4B:
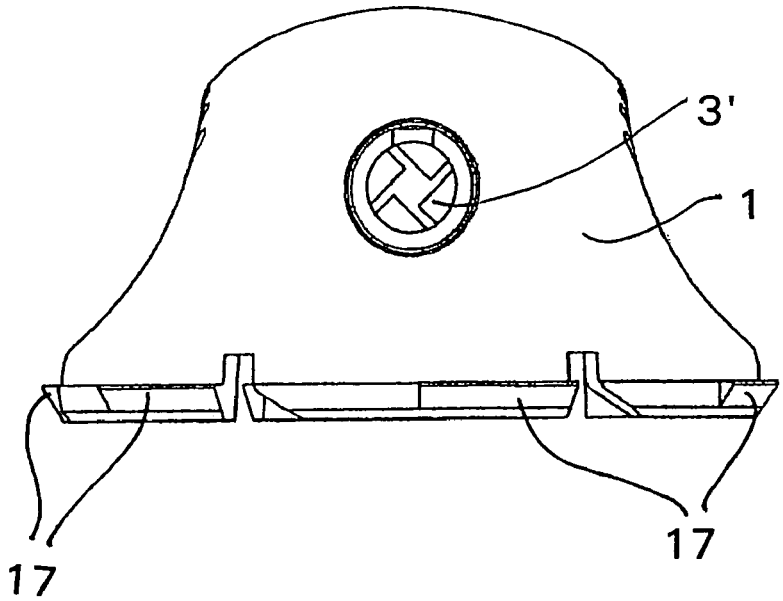

FIGS. 4A and 4B provide a further detailed view of the button 1 and mechanical breakup 3' of the present invention. Shown in a modified cross-type opening the mechanical breakup 3' assists in further aerosolizing the dispensed product and can be formed in a variety of shapes and configurations to perform this function. On an outermost lower edge 11 of the button 1 are provided a spaced apart series of base engaging lips or ledges 17 each ledge 17 having an end thereof coinciding with the slot 5 and proceeding partially circumferentially around the lower edge 11 in order to facilitate a relative radial freedom of movement of the button with respect to the base 2. The top edge of the ledge 17 engages inside to top edge 12 of the base 2 when the button 1 is inserted down into the base 2 through the top opening so that the ledges 17 fall underneath the edge 12 of the top opening in the base 2 and engage underneath the top edge 12 to keep the button 1 from being pulled vertically out of the top opening of the base 2.

Figure 5:
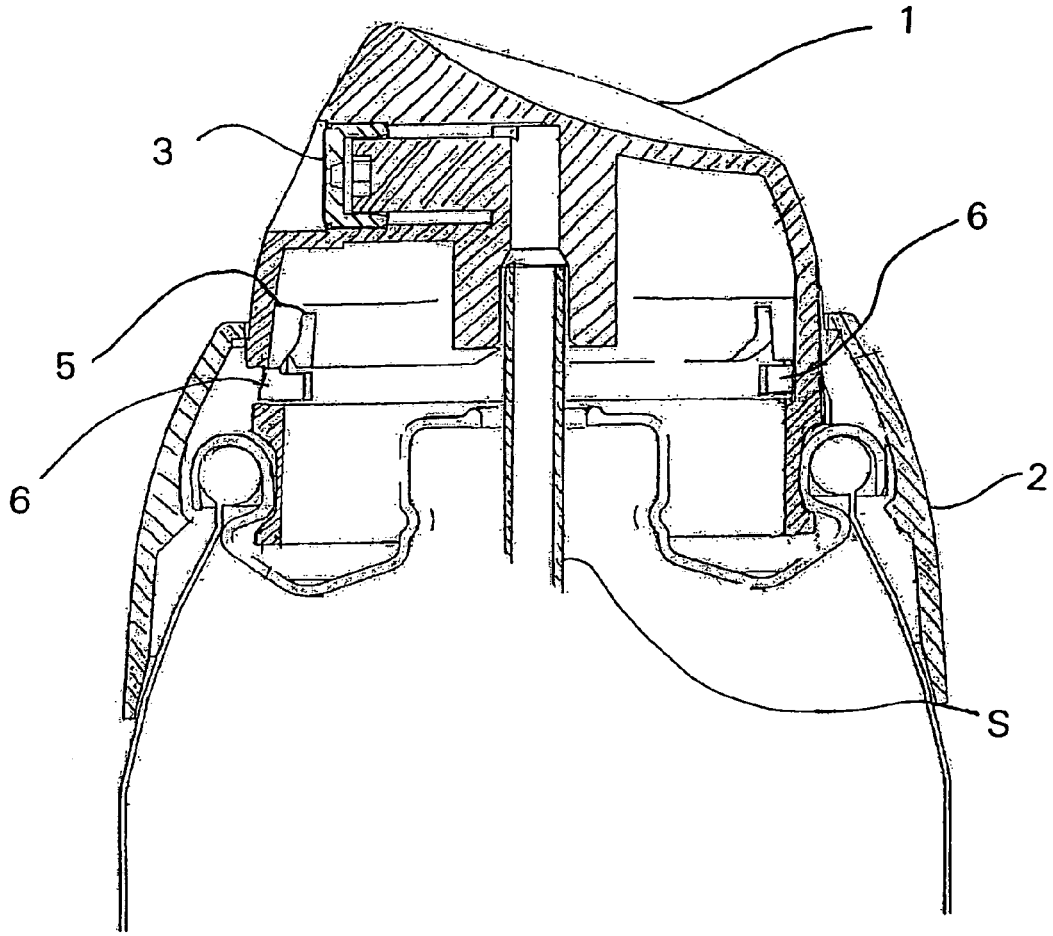
FIG. 5 is a cross-sectional view of a ring actuator in accordance with an embodiment of the present invention.

In another embodiment, a ring actuator, shown in FIG. 5, is somewhat similar to the previous twist top actuator, except that the button 1 is press fit onto the valve stem, and has a lower circumferential portion which directly engages an inner rim of the spray can C so as to resist radial rotation. Different from the twisting button in the previous embodiment, in the ring actuator the base 2 is rotatable relative to the button 1 between an actuating and a non-actuating position. In the actuating position shown in the FIG. 5, the support ribs 6 on the base 2 are rotated into position located below the slots 5 in the lower edge of the button 1 and thus the button 1 is free to press down on the valve stem S of the can C to release the contents thereof.

When the base 2 is rotated, or radially turned relative to the button 1, to the non-actuating position, the lowermost edge of the button 1 is pushed up onto and over the top of the support ribs 6 which prevents downward force on the button 1 from depressing the button 1 and actuating the valve stem of the spray can. Although the support ribs 6 in the base 2 can stop the button from being depressed, there is no structure in the actuator which prevents the relative rotation between the button 1 and the base 2, i.e. the button does not "lock" into any specific operative or inoperative position relative to the base. By "lock," it is intended that the button cannot be rotated relative to the base 2 without physical removal of some locking mechanism as described in many of the uncovered patents below. Again, a position indicating means as previously described may be provided to alert the user to the relative positioning of the base 2.

Figure 6:
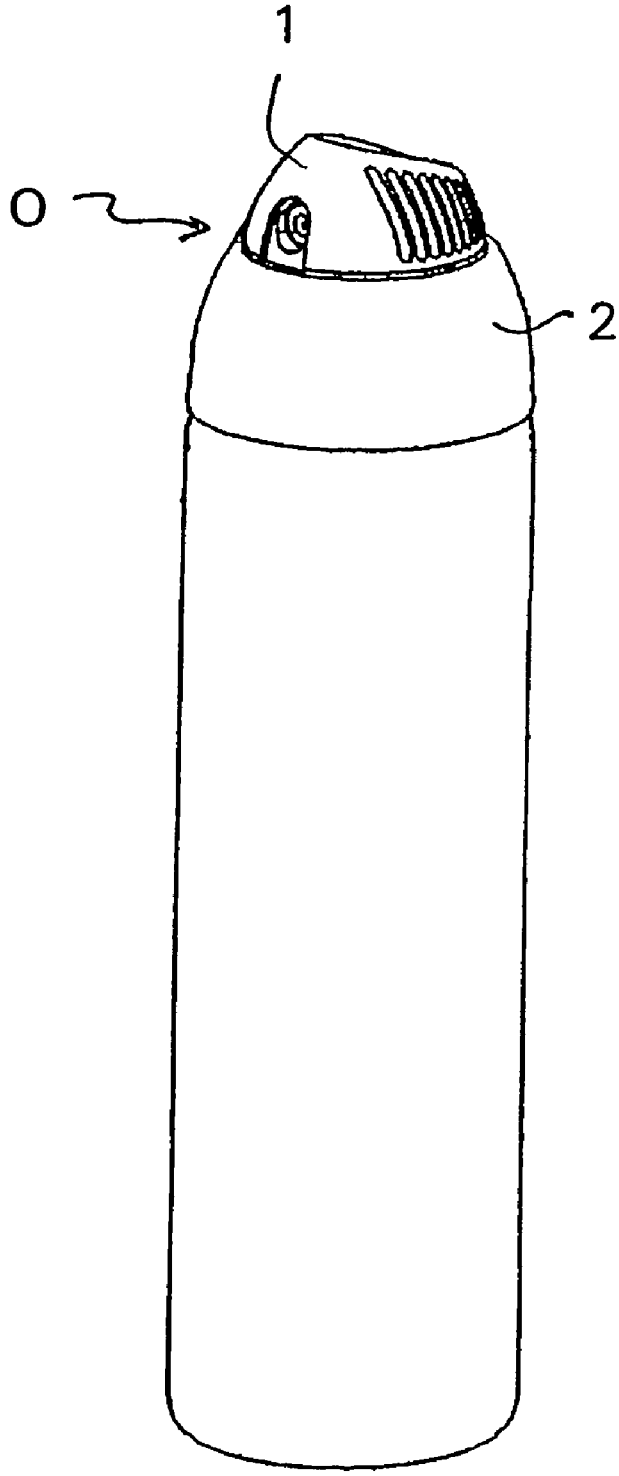
FIG. 6 is a perspective view of a second embodiment of the twist top actuator having an integral base and product passage in accordance with the present invention.
Figure 7A:
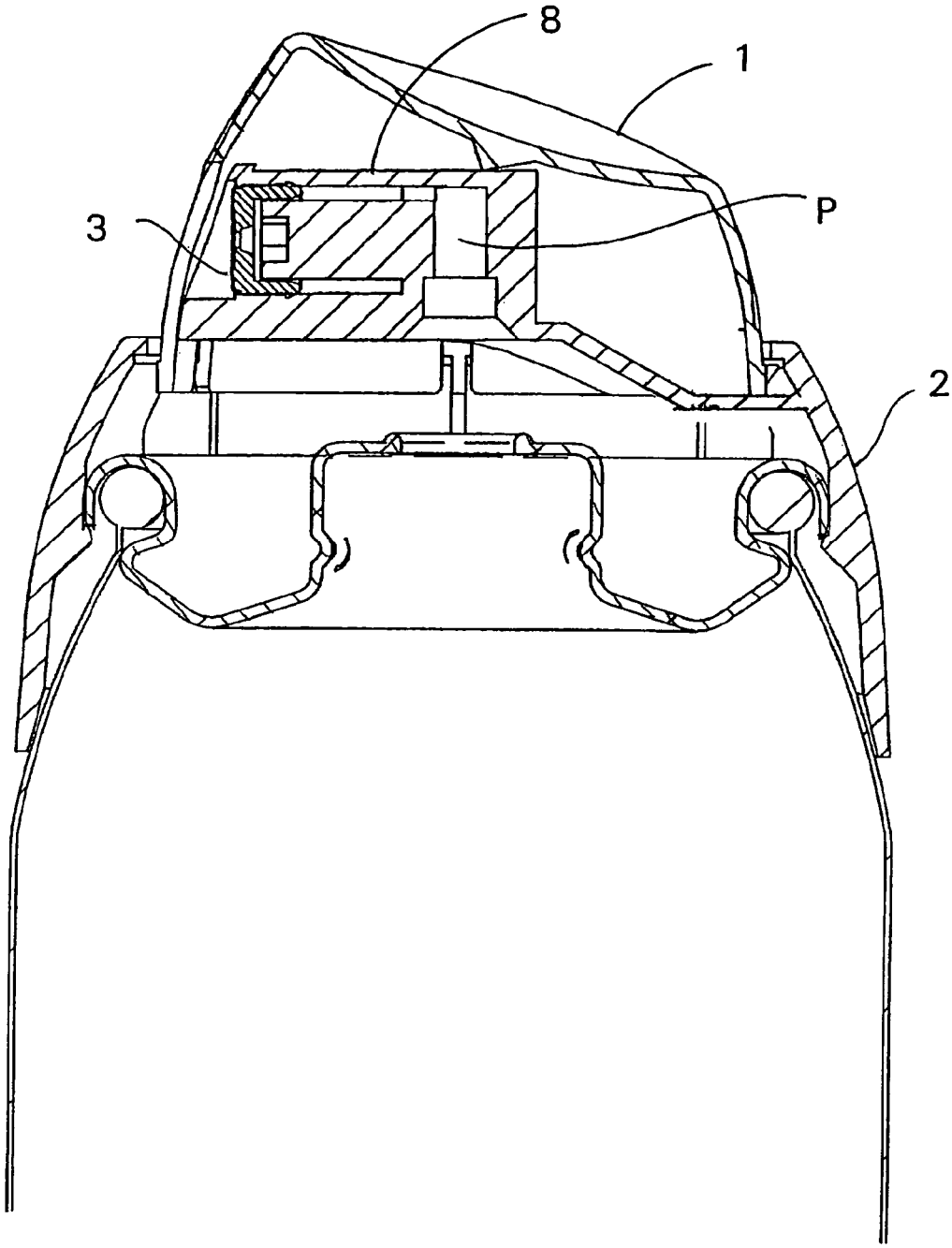
FIGS. 7A-B are respective cross-sectional views of the integral base and product passage for the twist cap actuator in accordance with an actuating and an actuated position of the present invention.
Figure 7B:
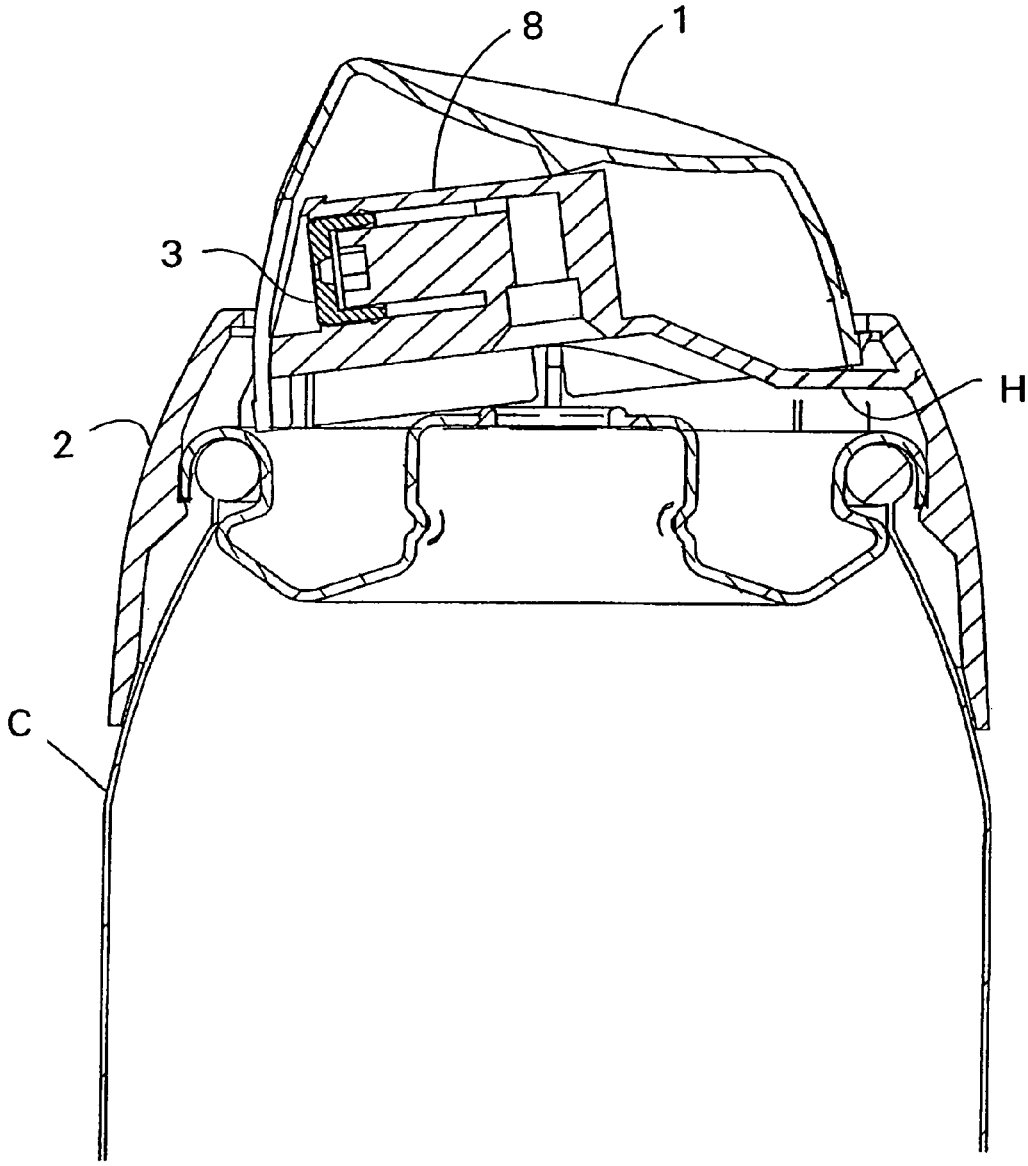
Figure 10A:
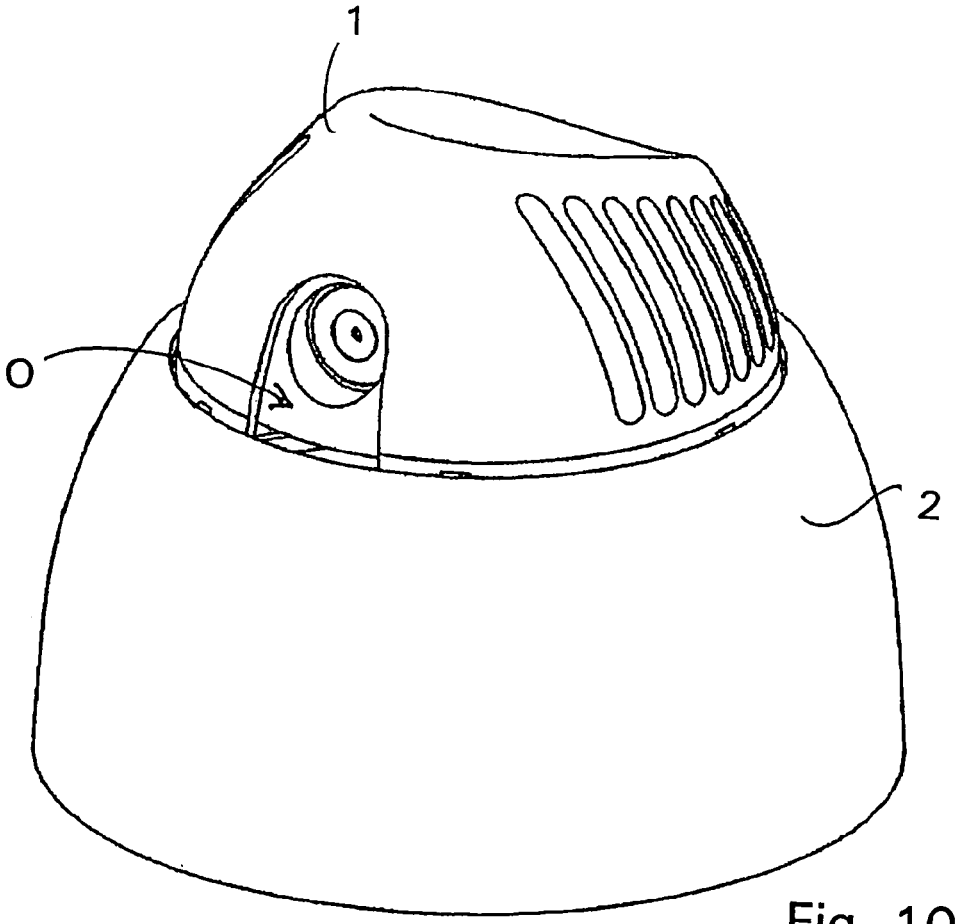
FIGS. 10A-B are perspective view of the button and base in an actuating and a non-actuating position respectively.
Figure 10B:
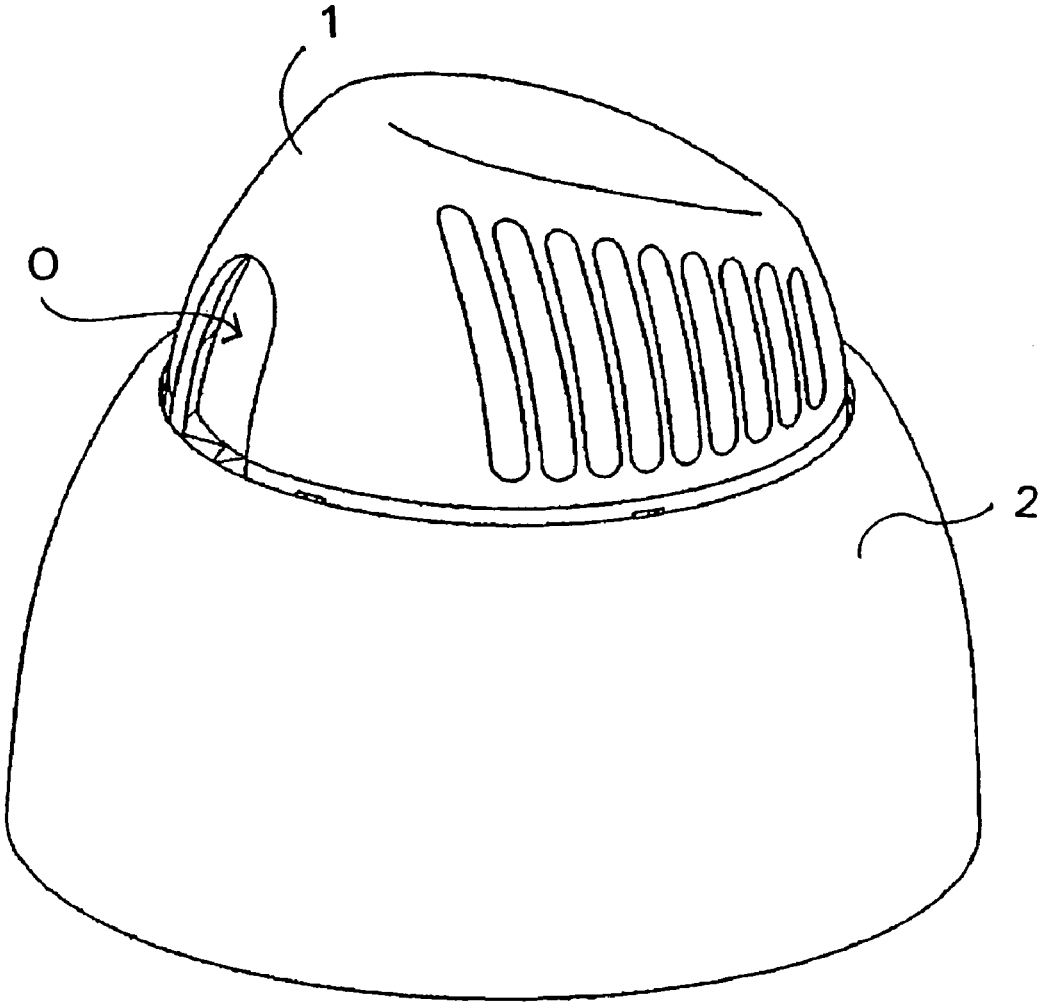
Figure 11:
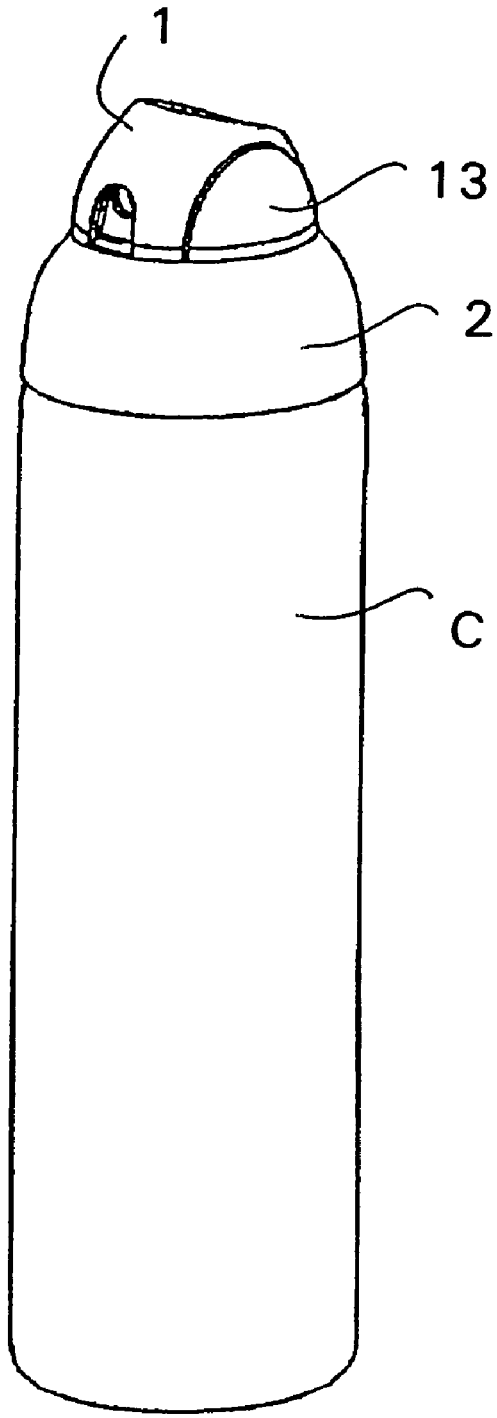
FIG. 11 is a front perspective view of a slide actuator with an aerosol spray can in accordance with another embodiment of the present invention.
Figure 12:
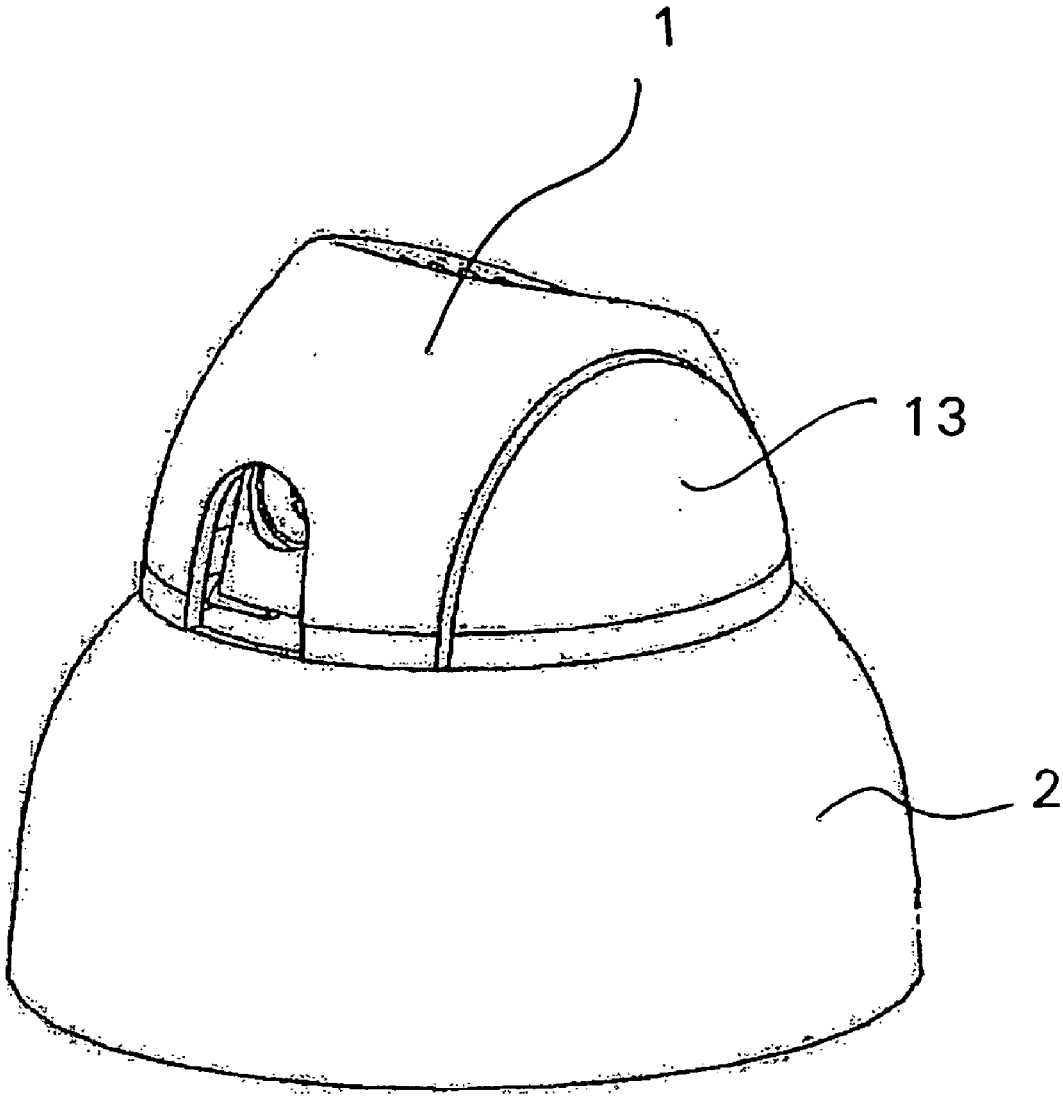
FIG. 12 is a front perspective view of the button and base of the slide actuator.

In yet another embodiment of the twist cap actuator, shown in FIGS. 6 and 7A-B, a product passage P is an integral part of the actuator base 2 rather than the button 1 as described in the previous embodiments. As seen in FIGS. 7A and 7B, the nozzle 3 is thus inserted in a nozzle arm 8 defining the outlet of the product passage P which is hinged to the base 2 so that the button 1 when pressed depresses the product passage P and hence the valve stem (not shown) upon actuation. Better seen in FIGS. 10A-B, the button 1 is provided with an opening 0 formed in a sidewall thereof which in the actuating position overlies the outlet orifice of the product passage P permitting the pressurized product to be ejected into the environment. In the non-actuating position shown in FIG. 10B when the button 1 is rotated, the opening 0 may be thus rotated away from the outlet and a sidewall of the button 1 will overlie the outlet.

The actuating and non-actuating positions of this embodiment are similar to those described above, the relative radial rotation between the base 2 and button 1 aligns the slots 5 in the button 1 with the support ribs 6 in the base 2 as shown in FIG. 7A. As seen in FIG. 7B when the button 1 is depressed, the nozzle arm 8 hinges about a living hinge H connecting the nozzle arm 8 to the base, and the slots 5 are permitted to pass downwards over the ribs 6. The living hinge H is integral between the product passage P and the base 2. The living hinge H may directly connect the wall of the base 2 with the nozzle arm 8 defining the passage P, or a modified rib structure may also form the hinge and support the passage as shown in FIGS. 8A-B.

Figure 8A:
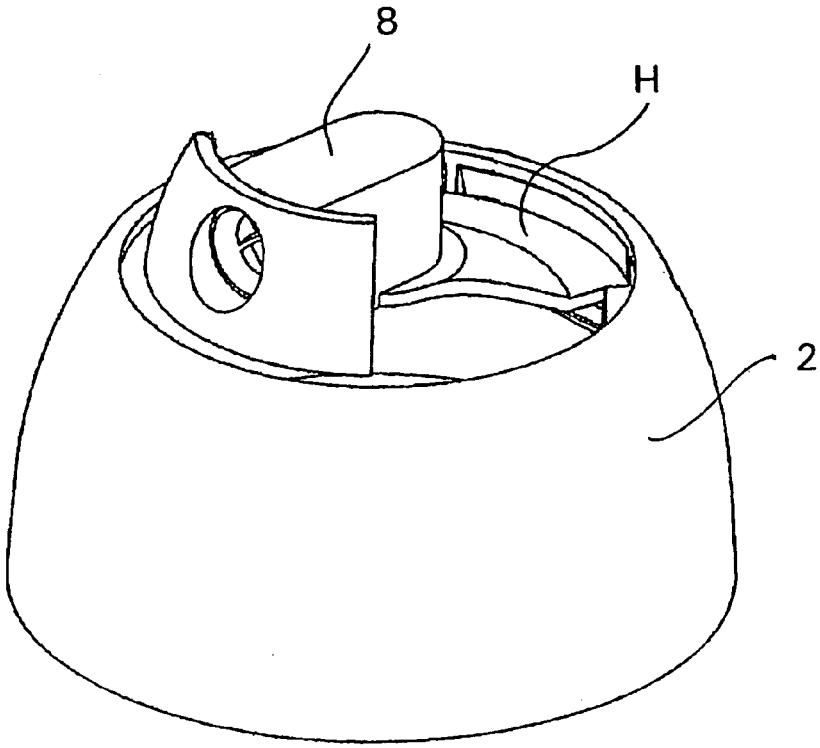
FIGS. 8A-B are a perspective and cross-sectional view of the integral base and product passage in accordance with the present invention.
Figure 8B:
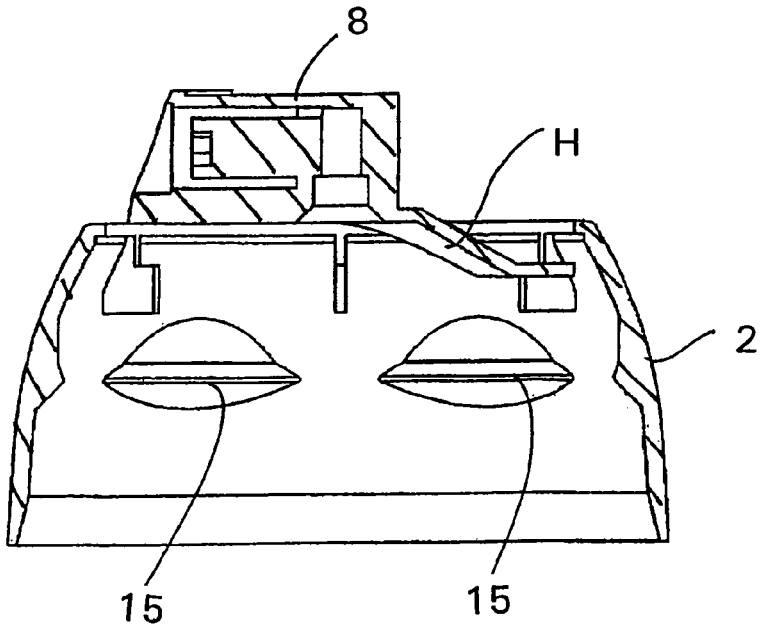

FIGS. 8A-B shows the base 2 or skirt and living hinge H in further detail, including the spray can collar engaging edges 15 which protrude circumferentially inwardly at least partially around an interior wall of the base 2. Each of these collar engaging edges 15 engages in a "snap-fit" over the collar of the spray can (as better seen in FIGS. 7A and 7B) to biasly engage underneath the collar or rim and thus secure the twist top actuator to the aerosol spray can. The ribs 6 are shown extending radially inwards from the inner wall of the base 2 and may be spaced any desired distance apart in order to facilitate the complete engagement and smooth operability of the button movement relative to the base 2.

Figure 9:
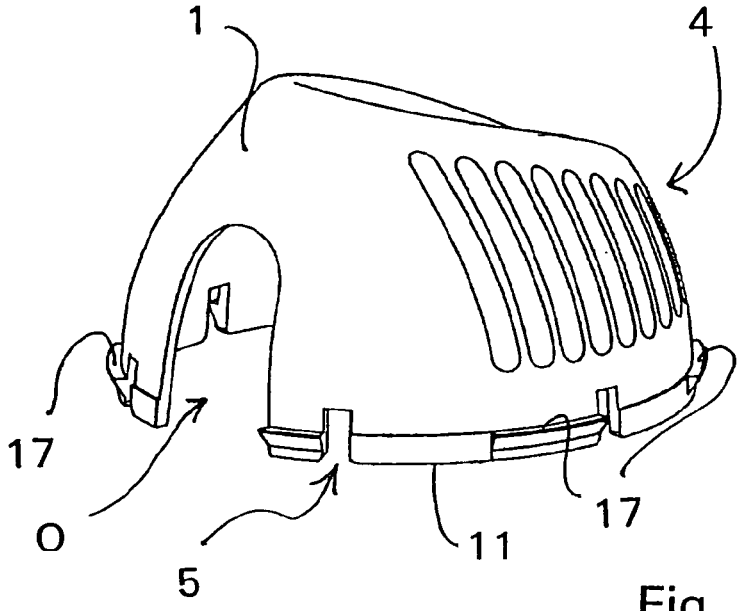
FIG. 9 is a perspective view of the button of the second embodiment of the twist cap actuator.

FIG. 9 provides a further detailed view of the button 1 of the present embodiment. On an outermost lower edge 11 of the button 1 are provided a spaced apart series of base engaging lips or ledges 17 each ledge 17 having an end thereof coinciding with the slot 5 and proceeding partially circumferentially around the lower edge 11 in order to facilitate a relative radial freedom of movement of the button with respect to the base 2. The top edge of the ledge 17 engages inside to top edge 12 of the base 2 when the button 1 is inserted down into the base 2 through the top opening so that the ledges 17 fall underneath the edge 12 of the top opening in the base 2 and engage underneath the top edge 12 to keep the button 1 from being pulled vertically out of the top opening of the base 2.

FIG. 9 also shows the button 1 for this embodiment having an opening 0 in the button 1 and also the slots 5 are shown with parallel sides however it is to be appreciated that the ramp edge of the previous embodiments may also be utilized. Further, the finger engaging portions 4 of the button are shown convex.

As in the previous embodiments, when the base 2 and button 1 are relatively rotated to the non-actuating position, the lowermost edge of the button 1 is pushed up onto the top of the support ribs 6 and prevents downward force on the button 1 from depressing the button 1 and actuating the valve stem of the spray can from spraying the contents of the can when the button 1 is pressed.

In a further embodiment, a slide actuator is shown in FIGS. 11-18. The top button 1 does not rotate radially relative to the base 2 as described in the previous embodiments, but rather slides radially and tilts substantially vertically to move the product passage P and actuate the valve stem. The button 1 is situated between two ears 13 formed in the base which extend upwards to encompass and guide the sides of the button 1.

Figure 13A:
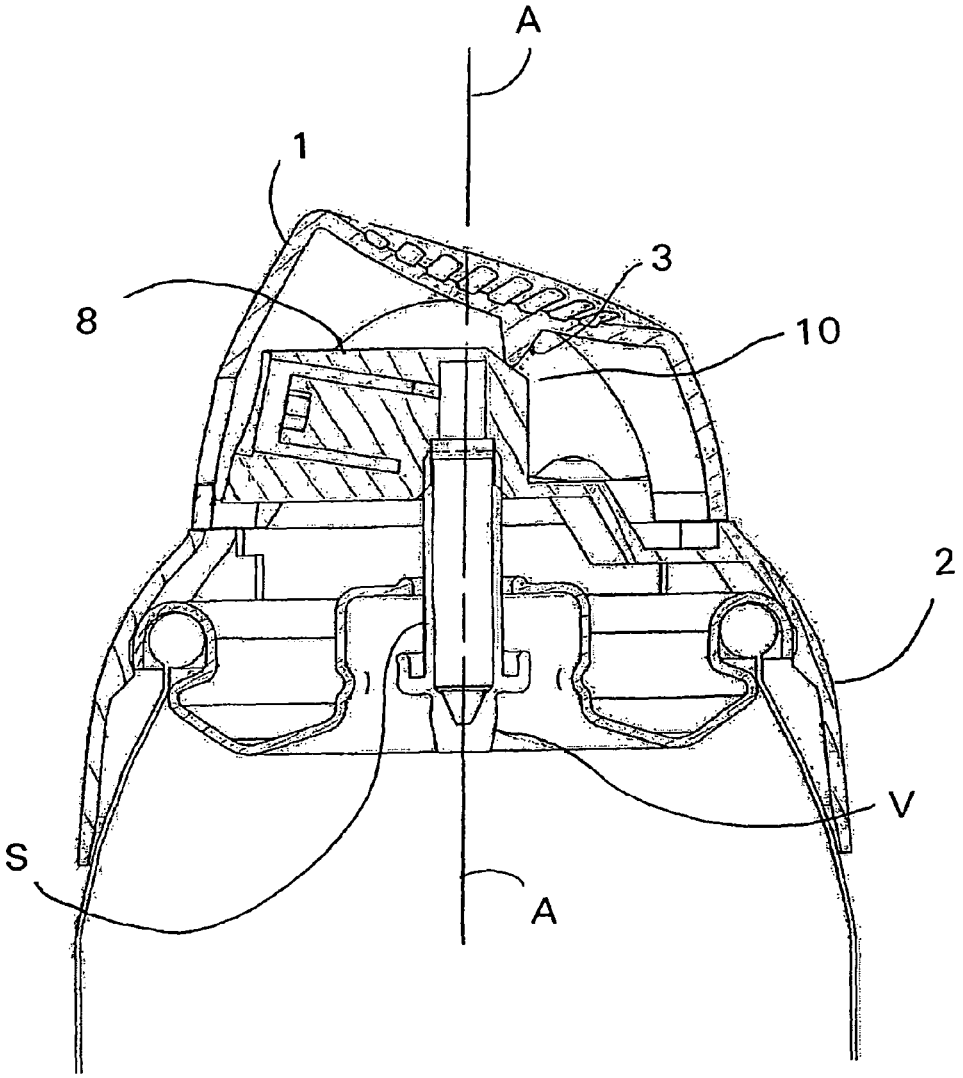
FIG. 13A-B are cross-sectional views of the slide actuator in a non-actuating position and an actuating position in accordance with an embodiment of the present invention.
Figure 13B:
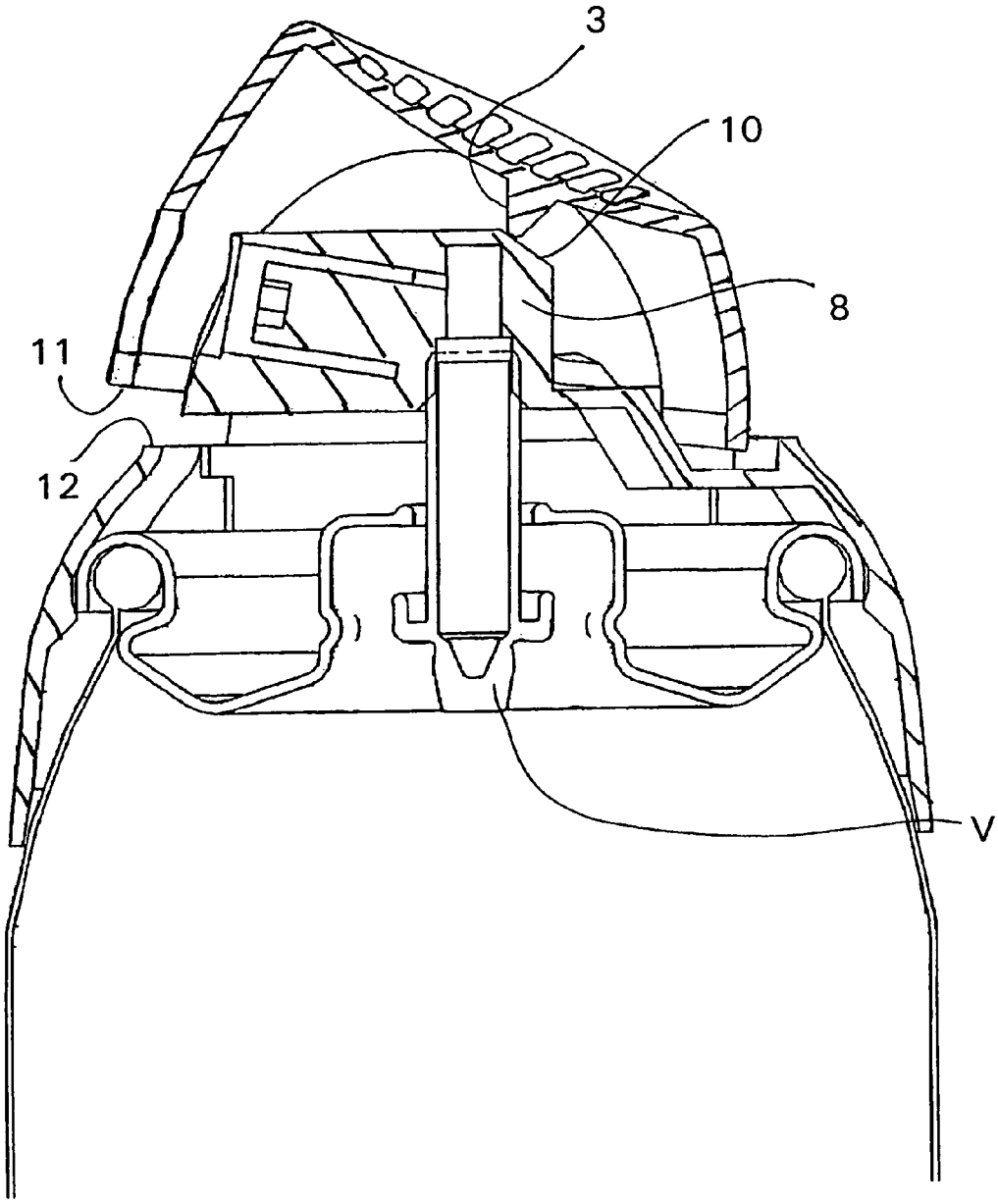

The nozzle arm 8 which includes the product passage P is an integral part of the base 2 as shown in FIGS. 13A-B. When the button 1 is in the non-actuating position as shown in FIG. 13A the lower edge 11 of the button rests on a top edge 12 of the base 2 and thus the button 1 cannot be pushed down relative to the base 2. To actuate this embodiment the button 1, as seen in FIG. 13B, is slid radially relative to the base 2 and longitudinal axis A. In other words, with the user thus radially pushing the button 1 relative to the axis A, this causes the button 1 to be slid substantially outward and upward relative to the base 2 and into a position with a depending protrusion or bump 3 on the button 1 riding a ramp 10 on the nozzle arm 8 to a position substantially aligned over the nozzle arm 8. The lower edge 11 of the button 1 is thus raised above the top edge 12 of the base 2 and a downward pressure on the button 1 will thus press down on the nozzle arm 8 causing actuation of the valve V.

Figure 14A:
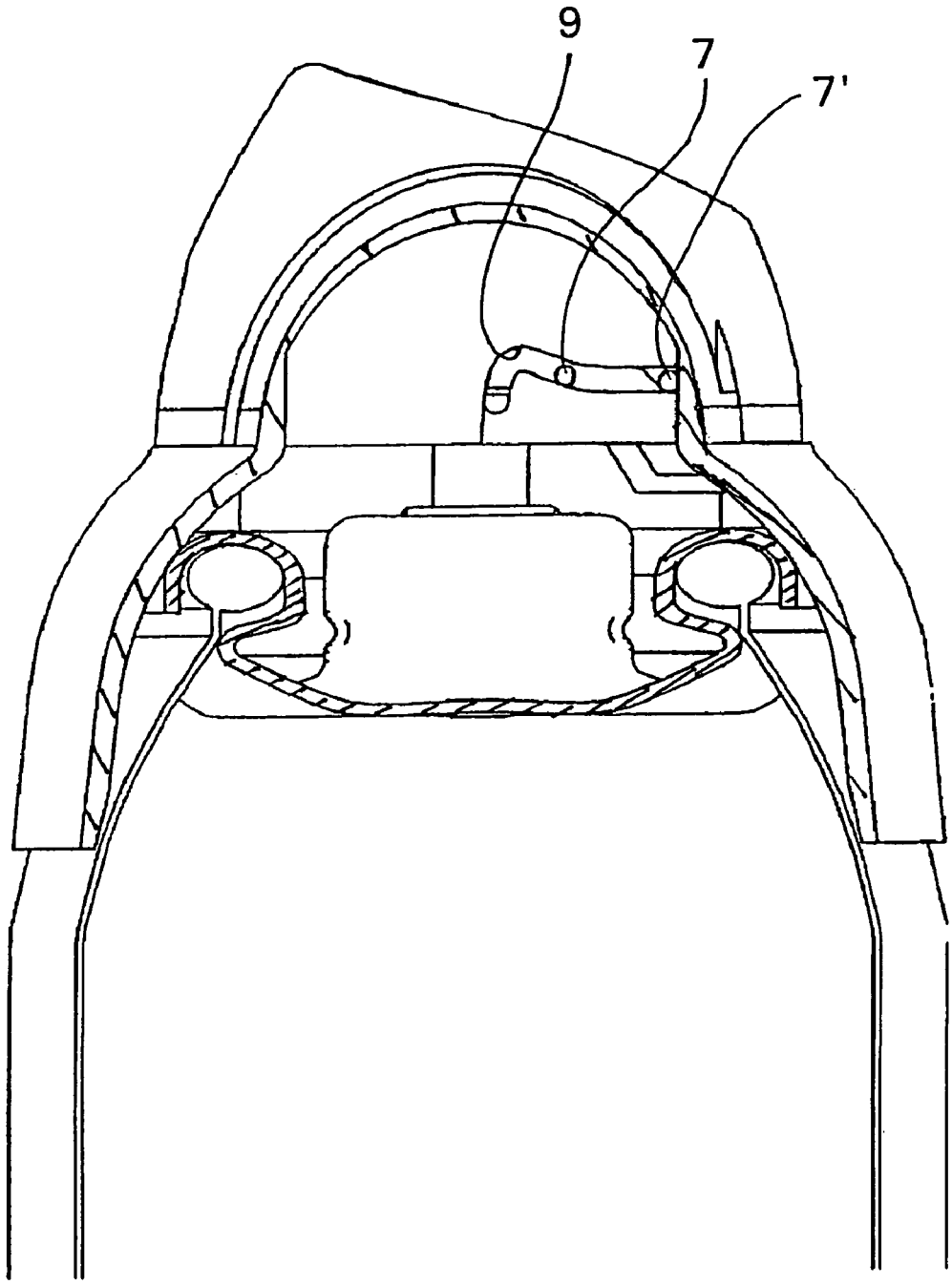
FIGS. 14A-C are further cross-sectional views of a slide actuator in a non-actuating, actuating and actuated positions in accordance with an embodiment of the present invention detailing the cam path actuation of the actuator.
Figure 14B:
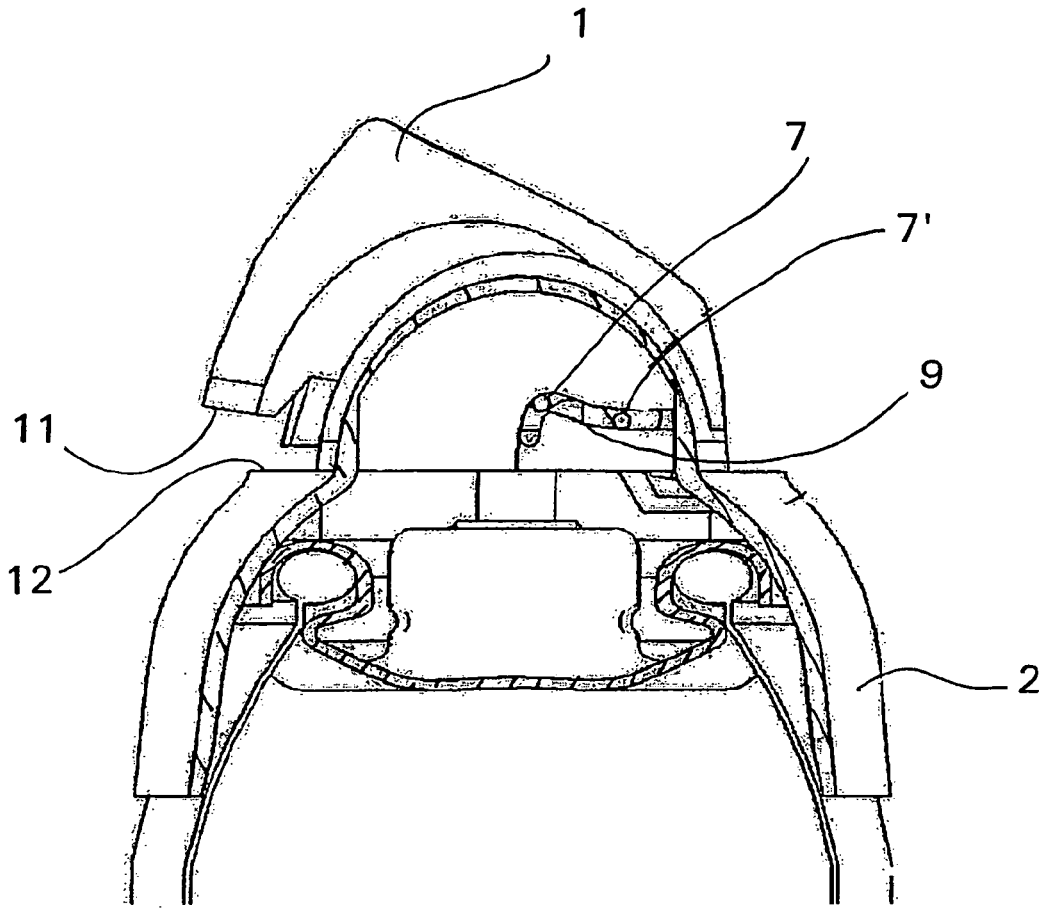
Figure 14C:
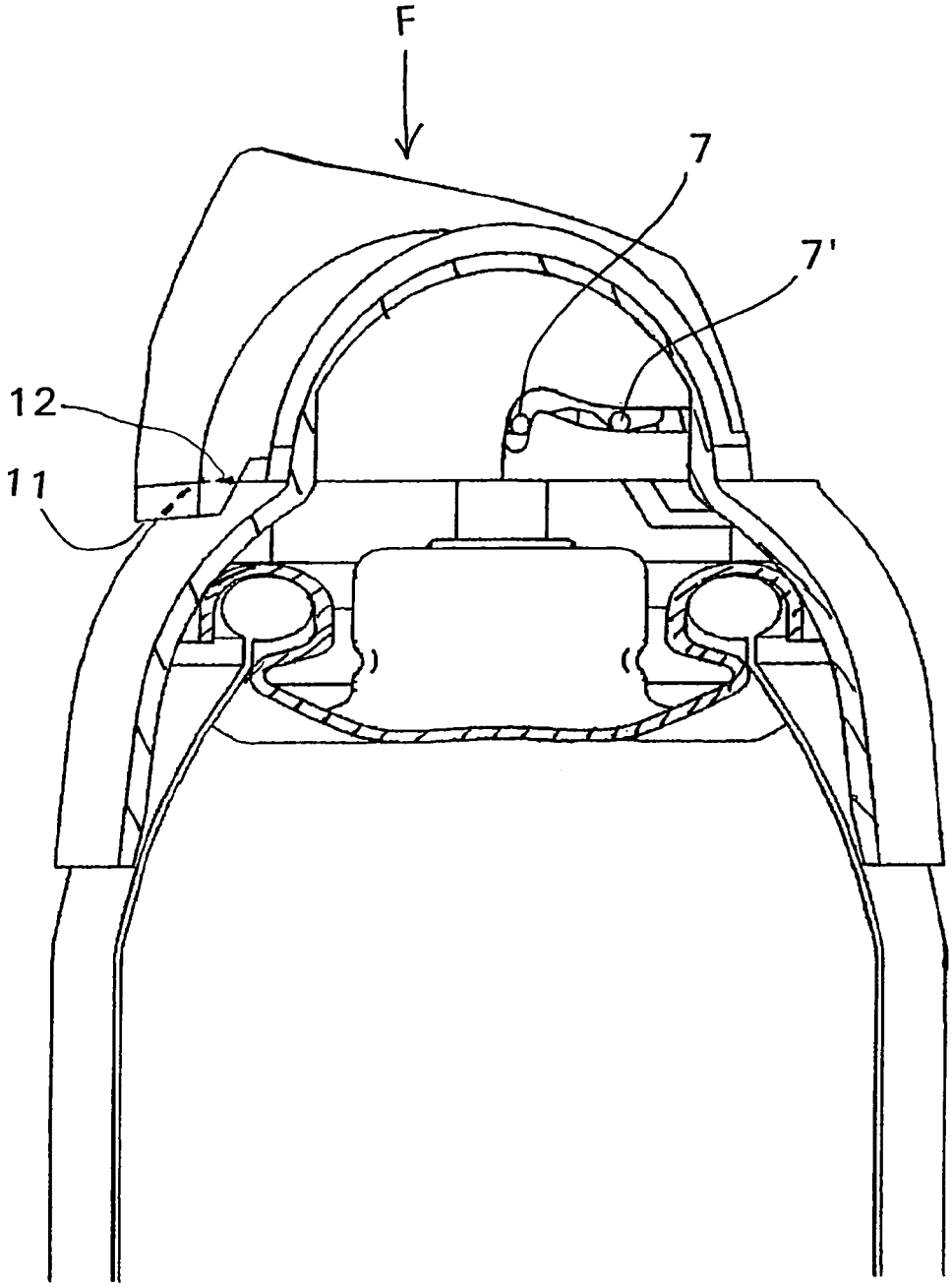

Turning to FIGS. 14A-C which show cut-away views of the slide actuator through the ears 13 which does not show the nozzle arm 8 and product passage P for purposes of clarity and better visibility, the button 1 is shown slidably affixed to the base via a pair of pivots 7 and 7' on at least one side of the button 1 being engaged with an associated slot 9 in the base 2. When the button 1 is slid forward and upward as shown in FIG. 14B, the front pivot is moved to a position where the front pivot 7 is permitted a degree of vertical freedom by the slot 9, while the rear pivot 7' remains vertically fixed as a pivot point about which the button 1 can rotate, or more aptly tilt, relative to the base 2 in order to actuate the nozzle arm 8 as seen in 14C where the button 1 has been pushed down and the front pivot 7 is permitted to move vertically downward in the slot 9. The front lower edge 11 of the button 1 is now radially offset from the top edge 12 of the base 2 and therefore is permitted to overlap to an extent necessary to depress the valve stem and actuate the valve.

When the button 1 is released by the user the bias of the nozzle arm 8 and the valve stem push the bump 3 rearward down the ramp 10 and the slot 9 guides the front and rear pivots 7, 7' back into a substantially horizontal alignment wherein the alignment the bottom edge 11 of the button 1 rests on a top rim of the base 12 and cannot be pushed downward relative thereto and thus the spray can cannot be actuated.

Figure 15:
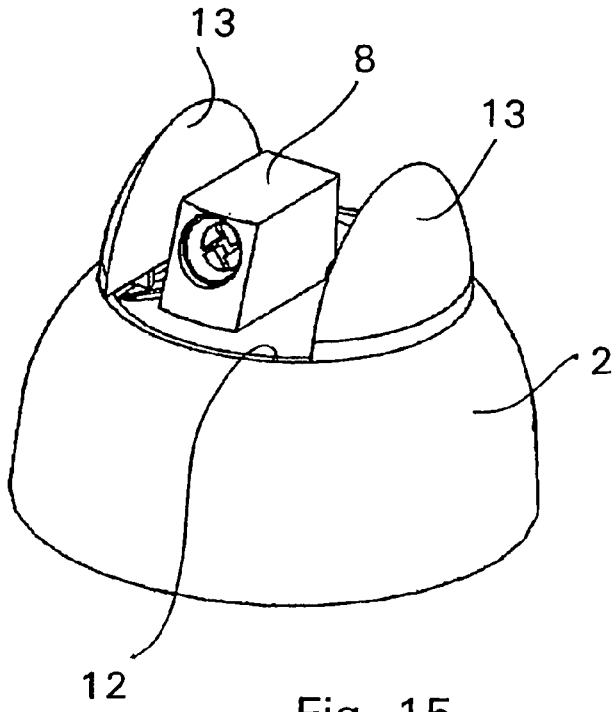
FIG. 15 is a front perspective view of the integral base and nozzle of the slide actuator.
Figure 16:
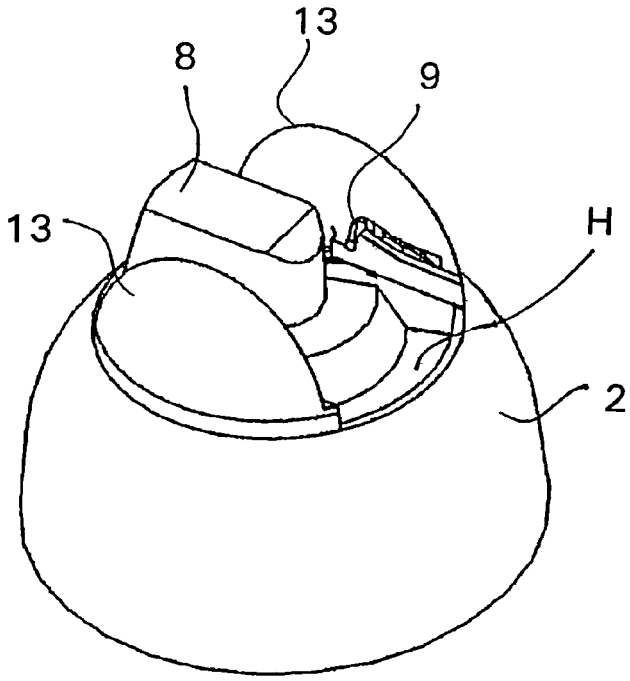
FIG. 16 is a side perspective view of the integral base and nozzle of the slide actuator.
Figure 17:
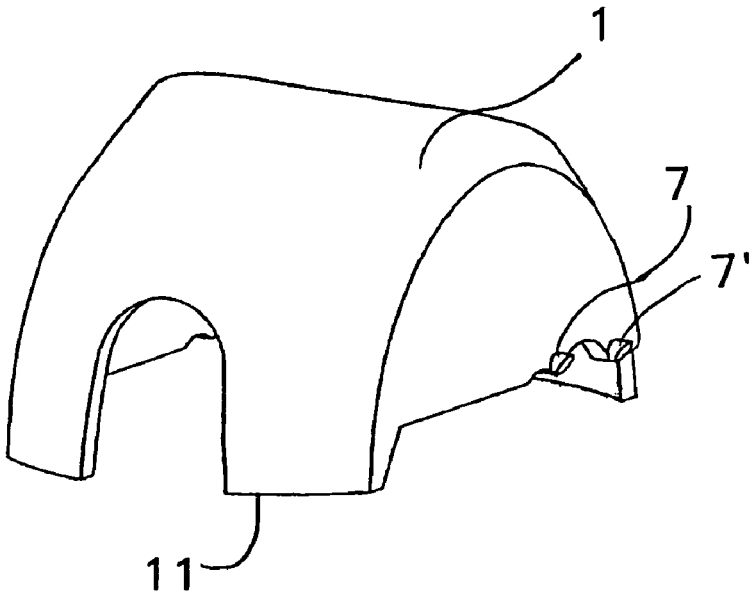
FIG. 17 is a front perspective view of the button of the slide actuator.
Figure 18:
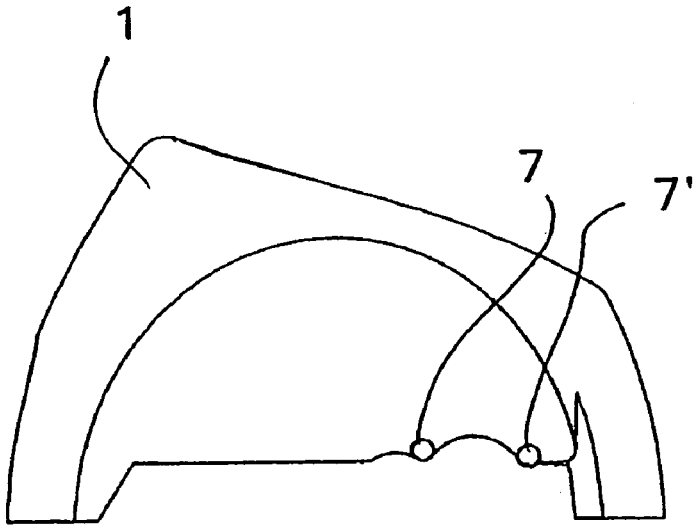
FIG. 18 is a planar side view of the button of the slide actuator.

FIGS. 15 and 16 show the base 2 of the present embodiment having the integral nozzle arm 8 attached via living hinge H with the base 2 and the slots 9 for captively retaining the button 1 between the ears 13 of the base. FIGS. 17 and 18 show the button 1 and pivots 7, 7' on the sides thereof for engaging the base 2 and the respective slots 9.

Figure 19:
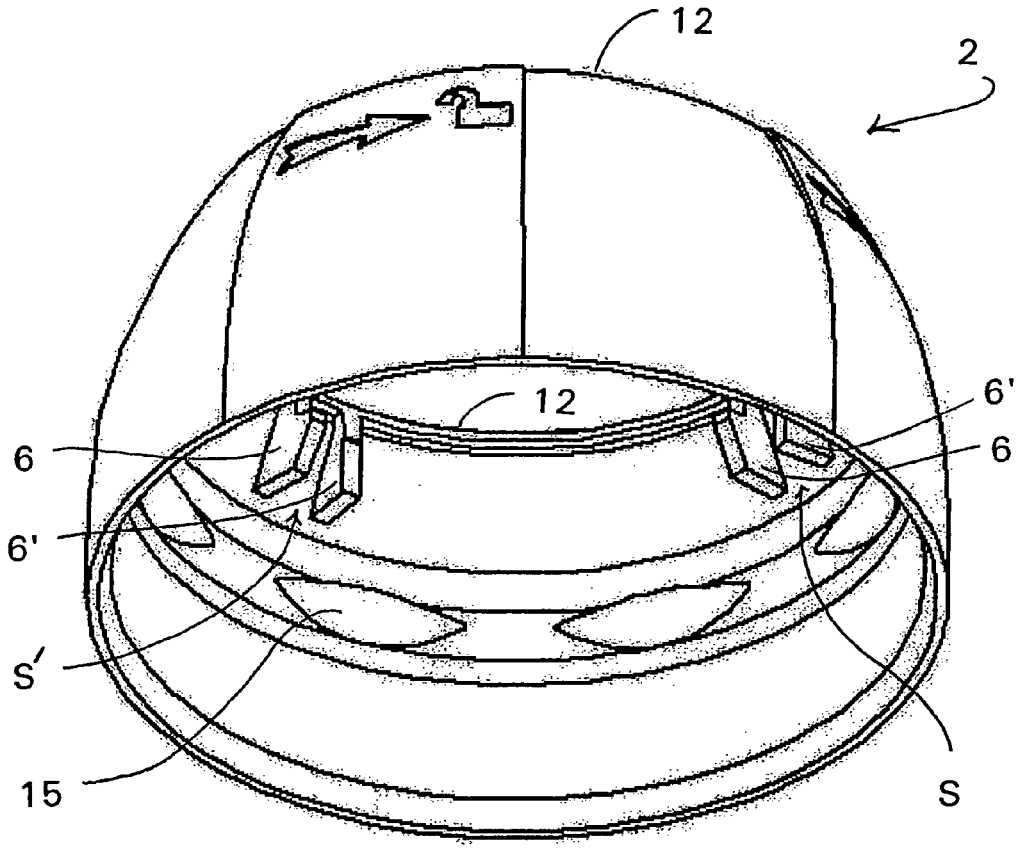
FIG. 19 is a perspective bottom view of the base according to another embodiment of the present invention.
Figure 20:
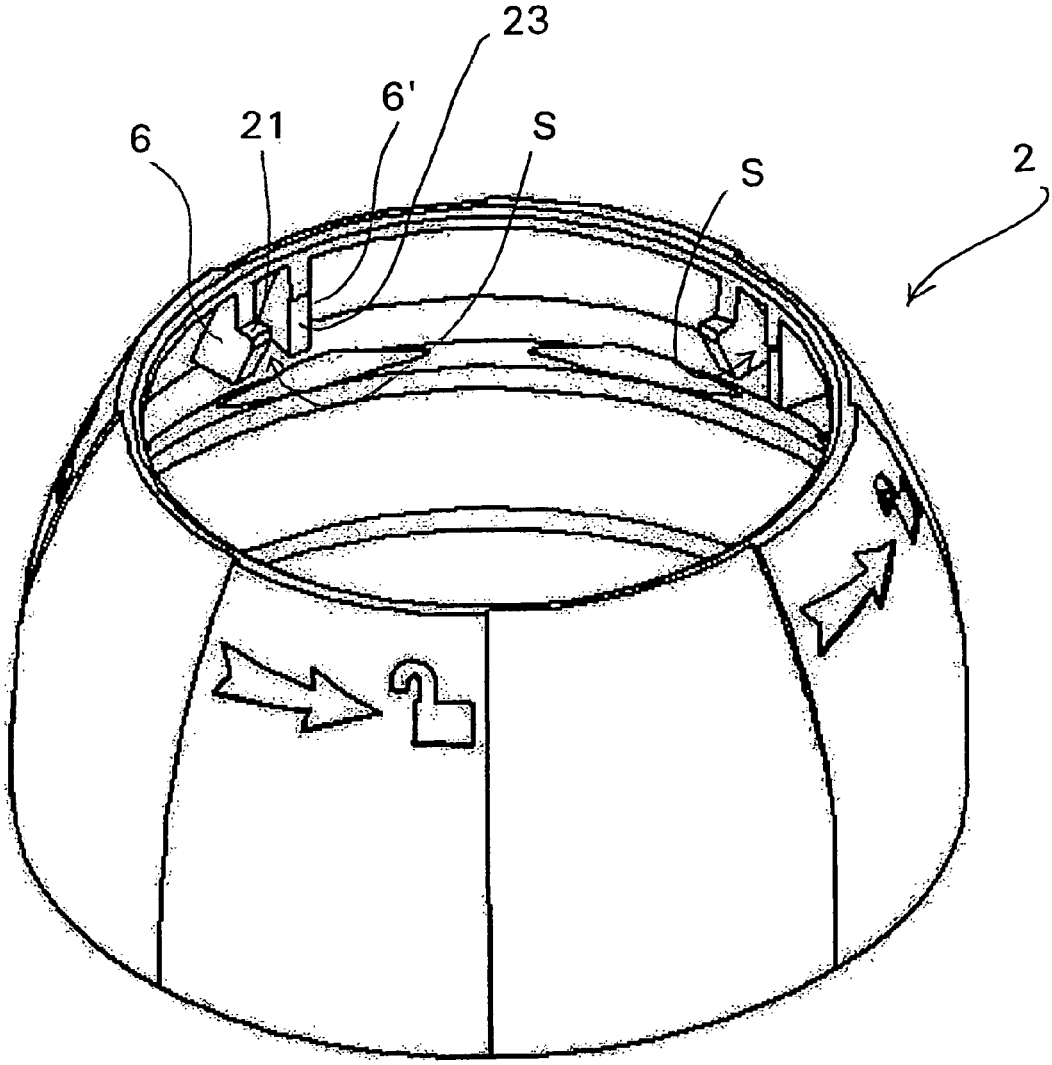
FIG. 20 is a perspective top view of the base according to this further embodiment of the present invention.
Figure 21:
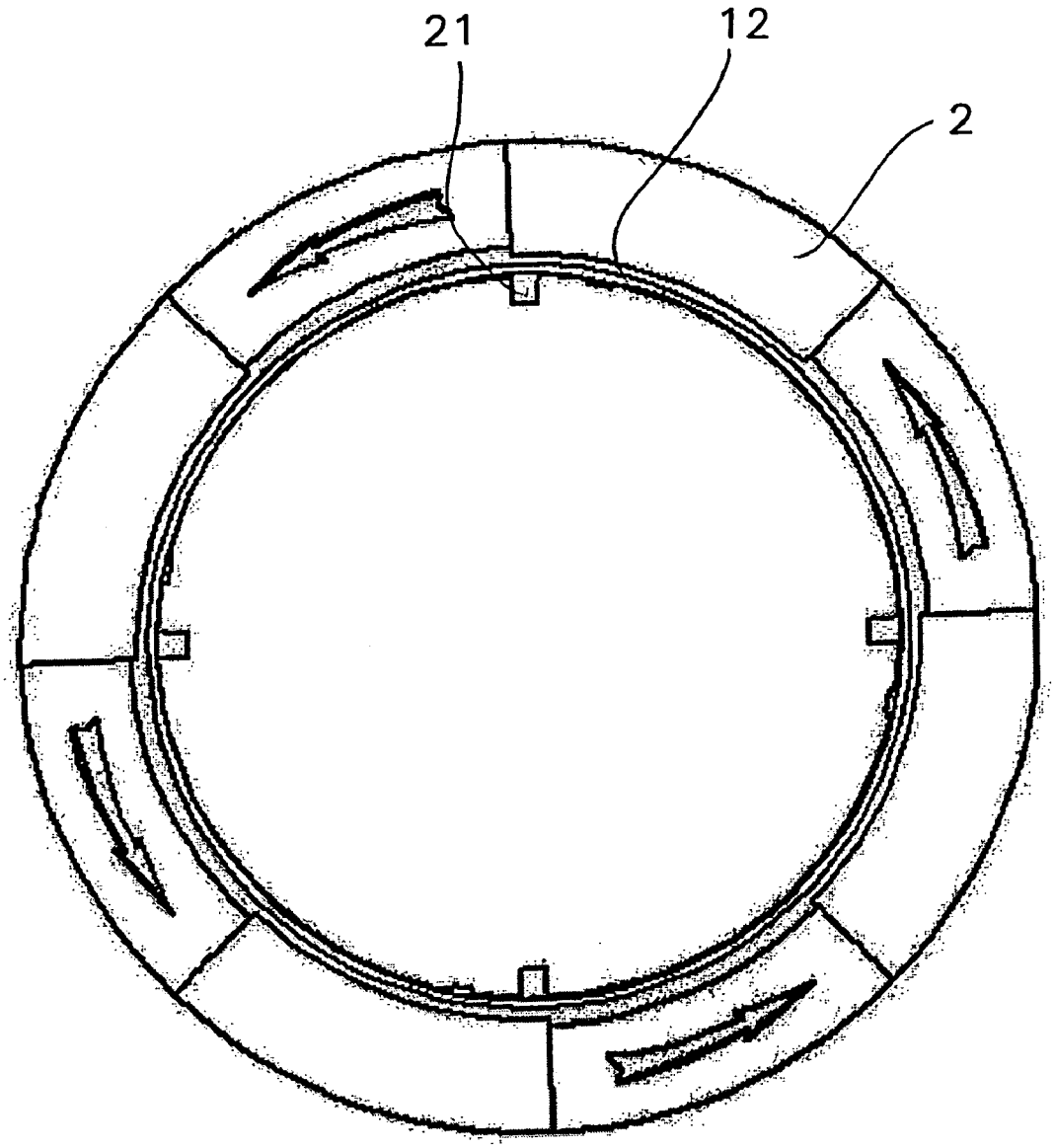
FIG. 21 is a top plan view of the base.

FIGS. 19-23 disclose yet another embodiment of the present invention. FIGS. 19, 20 and 21 show the base 2 of the twist top actuator similar to the embodiment of FIGS. 3A and 3B including the spray can collar engaging edges 15 which protrude circumferentially inwardly at least partially around an interior wall of the base 2. As in the previous embodiment, each of these collar engaging edges 15 engages in a "snap-fit" over the collar of the spray can (as seen in FIGS. 2A and 2B) to biasly engage underneath the collar or rim and thus secure the base 2 and hence the twist top actuator to the aerosol spray can.

Instead of a plurality of single ribs 6 spaced around an inside of the base 2, the present embodiment utilizes a pair, or pairs, of ribs including a first rib 6 and a second rib 6'. The pairs of first and the second ribs 6, 6' are positioned circumferentially around the top edge 12 of the base 2 and are generally vertically oriented and extend radially inwards from the inner wall of the base 2. Any number of pairs of ribs 6, 6' may be spaced around the top edge 12 in order to facilitate the complete engagement and smooth operability of the button 1 relative to the base 2.

The first rib 6 in the base 2 is provided with an upwardly facing horizontal surface 21 for engaging and supporting the bottom edge 11 of the button. The horizontal surface 21 provides a support for the button 1 to facilitate the radial rotation of the button 1 between the actuating position and the non-actuated position. In the non-actuated position, the horizontal surface 21 is in direct supporting contact with the lower edge 11 of the button so as to ensure that any downward pressure on the button does not cause depression of the button 1, and consequently the valve in the aerosol cannot be actuated. The ramp portion 19 assists in this regard and as the button 1 is rotated, the slanting ramp portion 19 vertically, i.e. axially, raises the bottom edge 11 up onto the horizontal surface 21 of the support ribs 6.

Consequently, in the non-actuated position the inlet passage 14 is axially moved relative to the valve stem S in an upward, vertical or axial relation. The valve stem S and the inlet passage 14 remain at least radially engaged as the valve stem S is generally in some manner engaged and supporting the button 1 even in the non-actuated position. When the inlet passage 14 is axially moved, i.e. raised relative to the valve stem S in the non-actuated position a space is formed between an inner ledge formed in the product passage P to directly press on the valve stem S, and the end of the valve stem S. This space provides for further protection against inadvertent actuation because in the non-actuating position the inner ledge of the product passage is spaced from the end of the valve stem. In other words, the slots 5 are rotated out of radial alignment with the ribs 6 and the product passage P is moved out of axial engagement with the valve stem forming the space which prevents downward force by the button 1 from actuating the valve stem S of the spray can C. In the actuated position, the button is rotated into a position where the slot 5 is poised above the horizontal surface 21 of the rib 6 to allow depression of the button 1 against the inherent bias of the aerosol valve and the button 1 is moved axially into engagement with the valve stem again. A further detailed description of the actuating and non-actuated positions will be provided below.

The second rib 6' is located at a slight distance from the first rib 6 to define a space S' therebetween. The second rib 6' is generally not provided with a horizontal surface 21 but forms a substantially planar vertically oriented edge, or radial support surface 23 extending radially inwards from the inner wall of the base 2 to a point adjacent an outer wall of the button, but which does not interfere with the vertical motion i.e. the depression and release of the button in any position. The second rib 6' is mainly a radial stop for limiting the radial rotation of the button and for working in cooperation with the first rib 6 to engage protrusions 25, 27 on the button 1. These protrusions 25, 27 on the button 1 are frictionally engaged in the space S' between the ribs 6, 6' so as to indicate in at least a tactile sense to the user the specific position of the button 1, i.e. the actuating or non-actuating position as discussed below.

Figure 22:
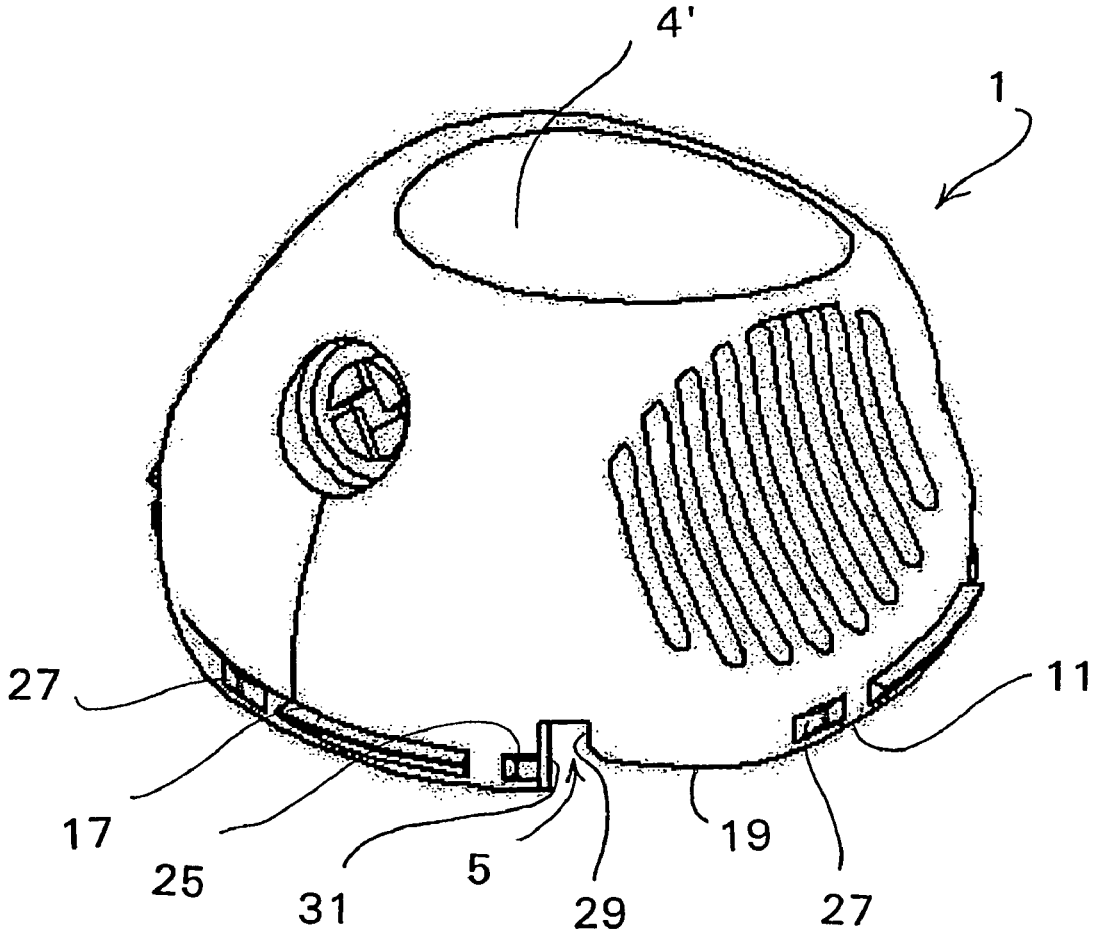
FIG. 22 is perspective top view of the button.
Figure 23:
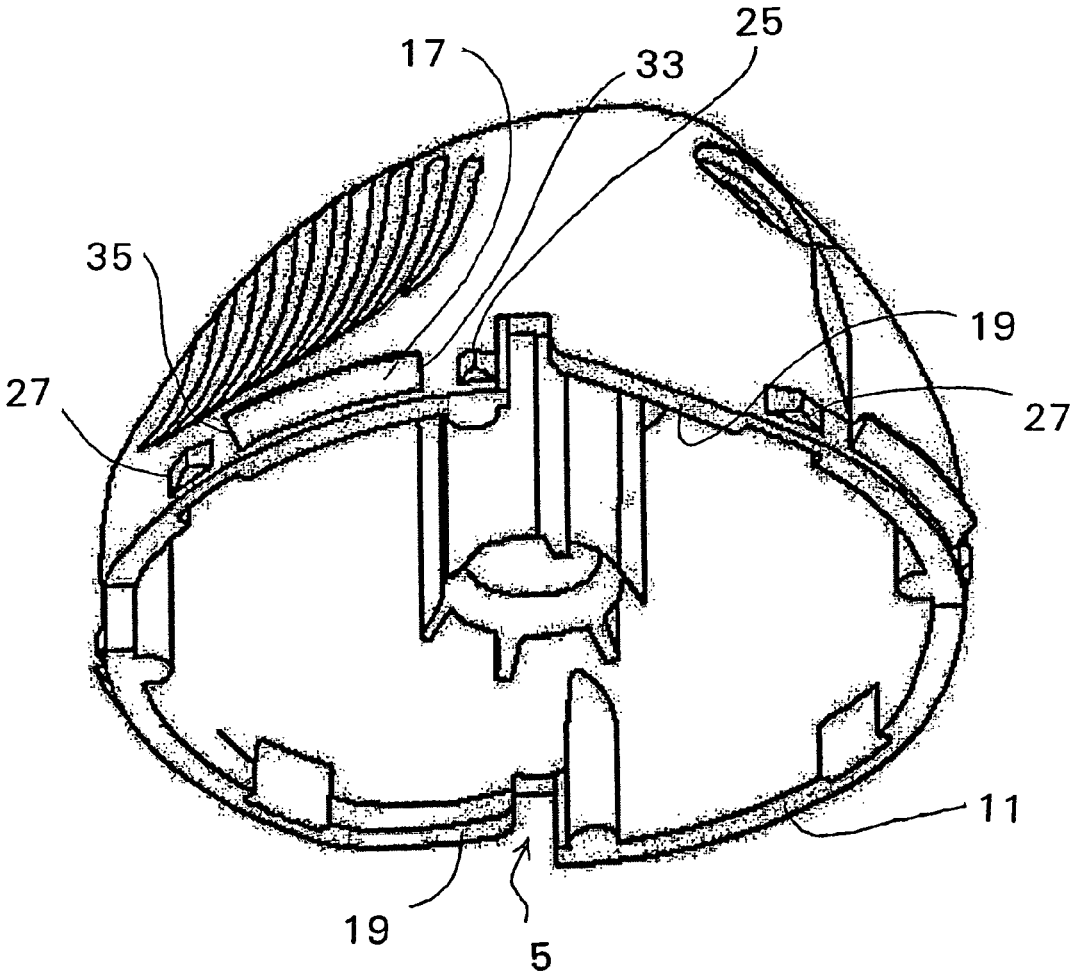
FIG. 23 is a perspective bottom view of the button according to this further embodiment of the present invention.

In this embodiment of the button 1 as shown in FIGS. 22 and 23, and similar to FIGS. 4A and 4B, the top surface of the button 1 defines the finger pad 4' or finger engaging surface where a user places their finger to apply pressure to actuate the button 1 in a vertical or straight up and down manner with no tilting of the button relative to the base 2. A bottom edge 11 of the button 1 is provided with at least a slot 5 or notch formed substantially perpendicular relative to the horizontal bottom edge 11. The slot 5 can be provided with a slanting ramp portion 19 which is formed at an angle between the bottom edge 11 and a first sidewall 29 of the slot 5. A second substantially vertical sidewall 31 is provided opposite the first sidewall 29 to define the slot 5. The ramp portion 19 assists in guiding the slot 5 into and out of the actuating and non-actuated positions over the relative support rib 6. It is to be appreciated that similar slots 5 may be provided around the circumference of the bottom edge 11 of the button 1 corresponding to the number of rib pairs so as facilitate the vertically biased movement of the button 1 relative to the base 2.

As shown in FIG. 23, on the outermost lower edge 11 of the button 1 are provided a spaced apart series of base engaging lips or ledges 17. Each ledge 17 has a first end nearly spaced from, or coinciding with the slot 5 and proceeding partially circumferentially around the lower edge 11 to a second end in order to facilitate a relative radial rotation of the button with respect to the base 2. Positioned between the slot 5 and the first end of ledge 17, an actuating protrusion 25 may be incorporated into the lower edge 11 of the button adjacent the slot 5 in order to engage in the space S' between the first and second ribs 6, 6'. This actuating protrusion 25 is slightly radially larger than the vertical oriented edge 23 of at least the second ribs 6' so that a slight increased amount of force is necessary to frictionally engage the actuating protrusion in the space S' between the first and second ribs 6, 6'. When the actuating protrusion 25 is aligned between the ribs 6, 6' the slot 5 is generally aligned in a vertical relation over the rib 6 in the actuating, or operable position to permit actuation of the button 1.

Adjacent the second end of the ledge 17 is provided a non-actuating protrusion 27 radially extending from adjacent the outermost lower edge 11 of the button 1. The non-actuating protrusion 27, as well as the actuating protrusion 25, may have a width or size approximately the same as the spacing S between the first and second ribs 6, 6' so at to fit cooperatively therebetween and also protrudes radially to an extent so as to require slightly more force by the user to engage either protrusion 25, 27 between the ribs 6, 6', as well as to remove the protrusions 25, 27 from engagement therein. This creates a tactile feel, and even an audible signal to the user that the button 1 has attained a desired position. The non-actuating protrusion 27 generally maintains the button 1 in an inoperable position where the lower edge 11 of the button is supported directly on top of the upper horizontal surface 21 of the rib 6.

When the button is inserted into the base 2, the top edge of the ledge 17 engages inside to top edge 12 of the base 2 when the button 1 is inserted down into the base 2 through the top opening thereof so that the ledges 17 fall underneath the edge 12 of the top opening in the base 2 and engage underneath the top edge 12 to keep the button 1 from being pulled, or pushed, axially out of the top opening of the base 2.

In the actuating position the slots 5 in the lower edge of the button 1 are located vertically above the support ribs 6 on the base 2 and the button 1 is free to press down on the valve stem S of the can to release the contents thereof. In this position, all the slots 5 are aligned vertically over the respective ribs 6 so that when the button 1 is pushed vertically straight up and down, all the ribs 6 are substantially concurrently received in the slots 5 as seen in FIG. 2B and the slot is sized so that there is enough vertical travel of the button 1 to depress the valve stem to the extent necessary to actuate the valve and release the pressurized product from the spray can C.

In the operable position, the actuating protrusion 25 incorporated into the lower edge 11 of the button and adjacent the slot 5 and the first end of ledge 17 engages in the space S' between the first and second ribs 6, 6'. Because, this protrusion 25 is slightly radially larger than an inner edge of the first and second ribs 6, 6' the protrusion 25 is maintained therein until an increased amount of radial force is used to disengage the protrusion 25 from between the first and second ribs 6, 6' upon completion of actuation of the button 1. Also, in the operable position the first end of the ledge 17 comes into contact with the second rib 6' so that further radial rotation in that direction is inhibited and with the actuating protrusion situated in the space S' between the first and second ribs 6, 6' the button is frictionally maintained in the radially operable position, but is free however to move in the axial direction.

To attain the non-actuating position similar to that as previously shown in FIG. 2C where the button 1 cannot be depressed to actuate the valve V by pushing down on the valve stem S, the button 1 is rotated, or turned in a radial manner, i.e. around the vertical axis A relative to the base 2. The actuating protrusion 25 is forced frictionally out of the space S' between the first and second ribs 6, 6', and the button 1 is rotated in such a manner that the ramp portion 19 of the button 1 rides up onto the horizontal surface 21 of the rib 6 until the respective non-actuating protrusion 27 adjacent the second end 35 of an adjacent ledge 17 is frictionally engaged in between the first and second ribs 6, 6'. In this manner the non-actuating position is attained where the lowermost bottom edge 11 of the button 1 rides up onto the horizontal surface 21 of the support ribs 6. In other words, the slots 5 are rotated out of radial alignment with the ribs 6 which prevents downward force on the button 1 from depressing the button 1 and actuating the valve stem S of the spray can C.

The ramp portion 19 assists in this regard and as the button 1 is rotated, the slanting ramp portion 19 vertically, i.e. axially, raises the bottom edge 11 up onto the top edge of the support ribs 6. Consequently, the inlet passage 14 is axially moved relative to the valve stem S in an upward, vertical or axial relation so that space is formed between an inner ledge formed in the product passage P to directly press on the valve stem S, and the end of the valve stem S. This space provides for further protection against inadvertent actuation because in the non-actuating position the inner ledge of the product passage is spaced from the end of the valve stem. In other words, the slots 5 are rotated out of radial alignment with the ribs 6 and the product passage is moved axially out of engagement with the valve stem which prevents downward force on the button 1 from depressing the button 1 and actuating the valve stem S of the spray can C.

Although the support ribs 6 in the base 2 prevent the button 1 from being depressed, there is no structure in the device which entirely prevents the relative radial rotation between the button 1 and the base 2, i.e. the button 1 does not "lock" into any specific operative or inoperative position relative to the base. In other words, the protrusions 25, 27 and engagement between the ribs 6, 6' may to some extent inhibit rotation of the button 1, they do not lock the button 1 so it cannot be turned. The protrusions 25, 27 act as a position indicating means such as a tactile, or even audible signal which makes the user aware of either the actuating or non-actuating position. This indicating means may provide some partial or limited resistance to relative rotation between the button 1 and base 2 via slightly overlapping radially or vertically oriented tabs, or other such type of minimally frictionally engaging elements as described above, but does not lock the button into any specific position. By "lock" we understand for example a child safety lock, wherein the button 1 cannot be rotated by a manual turning force relative to the base 2 without physical removal of a locking mechanism as described in many known devices.

Since certain changes may be made in the above described improvement, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. An aerosol spray actuator comprising:

an actuator base having a bottom end continuously supported by an aerosol container, and a top opening for engaging an actuator button retained by the actuator base;

a product passageway extending from a product receiving port to a product outlet for dispensing contents of the aerosol container into the environment;

an operative position enabling relative axial movement between the actuator base and the actuator button and a non-operative position of the aerosol spray actuator wherein the non-operative position interrupts relative axial movement between the actuator button and the actuator base so that any pressurized product in the aerosol container will not be dispensed, and one of the button and the actuator base are relatively radially rotatable between the operative position and the non-operative position an axial displacement means is provided for changing the axial relationship of the actuator button during relative radial rotation between the operative position and the non-operative position;

a plurality of horizontal support surfaces circumferentially spaced around the base to engage a lower edge of the button in the non-operative position and prevent relative axial movement between the button and the base; and a relief formed in the lower edge of the button which is radially aligned with the horizontal support surface inside the base in the operative position to permit relative axial movement between the button and the base.

2. The aerosol spray actuator as set forth in claim 1 wherein the actuator button includes a fluid outlet passage for communicating with a valve stem of the aerosol container and in the inoperative position the actuator button and the fluid outlet passage are axially and radially displaced relative to the actuator base and the valve stem.

3. The aerosol spray actuator as set forth in claim 1 further comprising a radial support surface formed in the base adjacent the horizontal support surface and defining a space between the horizontal and radial support surface.

4. The aerosol spray actuator as set forth in claim 3 further comprising a first protrusion formed on an outer surface of the actuator button for frictionally engaging in the space between the horizontal and radial support surfaces to define one of an operative position and a non-operative position of the button.

5. The aerosol spray actuator as set forth in claim 4 further comprising a second protrusion also formed on the outer surface of the button and spaced from the first protrusion for frictionally engaging in the space between the horizontal and radial support surfaces to define one an operative position and a non-operative position of the button.

6. The aerosol spray actuator as set forth in claim 5 wherein the product passageway extending from the product receiving port to the product outlet for dispensing contents of the aerosol container into the environment is integrally formed with the button.

7. An aerosol spray actuator for use with an aerosol container comprising:

an actuator base defining an opening for receiving a relatively radially rotatable and axially displaceable actuator button therein;

a plurality of stops formed in the actuator base defining limits for the radial rotation and axial displacement between the button and the actuator base;

a plurality of engagement means formed on the actuator button for abutting the plurality of stops at the defined limits of the radial rotation;

an operative position enabling relative axial movement between the actuator base and the actuator button and a non-operative position of the aerosol spray actuator wherein the non-operative position interrupts relative axial movement between the actuator button and the actuator base so that any pressurized product in the aerosol container will not be dispensed;

an axial displacement occurs between the actuator button and actuator base during radial rotation between the operative position and the non-operative position;

the plurality of stops includes at least one pair of stops having an horizontal support surface formed inside the base to engage a lower edge of the actuator button in the non-operative position and prevent relative axial movement between the actuator button and the actuator base;

a relief formed in the lower edge of the actuator button which is radially aligned with the horizontal support surface inside the actuator base in the operative position to permit relative axial movement between the button and the base; and wherein the actuator button includes an integral fluid outlet passage for communicating with a valve stem of the aerosol container and in the non-operative position the actuator button and the fluid outlet passage are axially and radially displaced relative to the actuator base and the operative position.

8. The aerosol spray actuator as set forth in claim 7 wherein the pair of stops defines a space therebetween for receiving at least a radially extending engagement means on the actuator button.

9. The aerosol spray actuator as set forth in claim 8 wherein the radially extending engagement means has a circumferential width corresponding substantially to the space between the stops forming the radial pair of stops.

10. The aerosol spray actuator as set forth in claim 7 further comprising an axial space formed between a fluid outlet passage in the actuator and a valve stem of the aerosol container in the inoperative position so that inadvertent movement of the actuator button does not influence the valve stem.

11. A method of operating an aerosol valve of an aerosol spray can via an aerosol spray actuator comprising the steps of:

engaging an actuator button in an opening of the actuator base and continuously engaging a bottom end of the actuator base on an aerosol container;

forming a product passageway extending from a product receiving port to a product outlet integrally in the actuator button for communicating with the aerosol valve and dispensing contents of the aerosol container into the environment; and defining an operative position enabling relative axial movement between the actuator base and the actuator button and a non-operative position of the aerosol spray actuator wherein the non-operative position interrupts relative axial movement between the actuator button and the actuator base so that any pressurized product in the aerosol container will not be dispensed;

radially rotating the actuator button and the actuator base between the operative position and the non-operative position;

axially displacing the actuator button relative to the actuator base when the button and the actuator base are relatively radially rotated between the operative position and the non-operative position; and forming a relief in a lower edge of the button which is radially aligned with a horizontal support surface inside the base in the operative position to permit relative axial movement between the button and the base.

12. The method of operating the aerosol valve of an aerosol spray can via the aerosol spray actuator as set forth in claim 11 further comprising the steps of forming an axial space between a fluid outlet passage in the actuator and a valve stem of the aerosol valve in the inoperative position so that inadvertent movement of the actuator button does not influence the valve stem.

* * * * *